US005498835A

United States Patent [19]

Ichiki

[11] Patent Number: 5,498,835

[45] Date of Patent: Mar. 12, 1996

[54] DIGITAL SIGNAL PROCESSING APPARATUS FOR APPLYING EFFECTS TO A MUSICAL TONE SIGNAL

[75] Inventor: Tetsuji Ichiki, Hamamatsu, Japan

[73] Assignee: Yamaha Corporation, Japan

[21] Appl. No.: 28,843

[22] Filed: Mar. 10, 1993

[30] Foreign Application Priority Data

Mar. 10, 1992 [JP] Japan ..... 4-051898
Feb. 24, 1993 [JP] Japan ..... 5-035862

[51] Int. Cl.[6] ..... G10H 1/02; G10H 7/00

[52] U.S. Cl. ..... 84/630; 84/661; 84/DIG. 26

[58] Field of Search ..... 84/629, 630, 661, 84/DIG. 4, DIG. 26

[56] References Cited

U.S. PATENT DOCUMENTS

| | | | |
|---|---|---|---|
| 4,472,993 | 9/1984 | Futamase et al. . | |
| 4,706,291 | 11/1987 | Kakubo et al. | 381/63 |
| 4,803,731 | 2/1989 | Niimi et al. | 381/63 |
| 4,909,121 | 3/1990 | Usa et al. | 84/606 |
| 4,998,281 | 3/1991 | Sakata | 381/63 |
| 5,286,913 | 2/1994 | Higashi | 84/622 |
| 5,380,950 | 1/1995 | Kunimoto | 84/661 |
| 5,410,603 | 4/1995 | Ishiguro et al. | 84/626 X |

FOREIGN PATENT DOCUMENTS

| | | |
|---|---|---|
| 0248527 | 12/1987 | European Pat. Off. . |
| 1-19593 | 4/1989 | Japan . |

*Primary Examiner*— William M. Shoop, Jr
*Assistant Examiner*—Jeffrey W. Donels
*Attorney, Agent, or Firm*—Graham & James

[57] ABSTRACT

A designating mechanism generates filtering designation data, which designate the contents of filtering, reverberating designation data, which designate the contents of reverberation, and characteristics data, which express the combined contents of filtering and reverberation. A parameters generating mechanism generates filtering parameters expressing filtering characteristics, and generates reverberating parameters expressing reverberation characteristics. A readout device reads out a first operating algorithm, which designates filtering designation data, and a second operating algorithm, which designates reverberating designation data, from a memory mechanism wherein a plurality of operating algorithms are stored. A computing mechanism creates a digital filter having characteristics corresponding to filtering parameters, based on the first operating algorithm, creates an operating unit having reverberation characteristics corresponding to reverberating parameters, based on the second operating algorithm, operates this digital filter and this operating unit in a time shared manner, and processes filtering and reverberation in parallel.

13 Claims, 12 Drawing Sheets

| CLOCK | 0 | | | | | | | | 1 | | | | | | | | 2 | | | | | | | |
|---|---|---|---|---|---|---|---|---|---|---|---|---|---|---|---|---|---|---|---|---|---|---|---|---|
| | 0 | 1 | 2 | 3 | 4 | 5 | 6 | 7 | 0 | 1 | 2 | 3 | 4 | 5 | 6 | 7 | 0 | 1 | 2 | 3 | 4 | 5 | 6 | 7 |
| SELECTOR 51 | | | | | | | | C | | A | | | | | -B | | | | | B | | | | |
| SELECTOR 52 | | | | | | | | B | | A | | | | | A | | | | | A | | | | |
| FULL ADDER 57 | | | | | | | | | X | | X | | | | | X | | | | | X | | | |
| SELECTOR 53 | | | | | C | | | | | | | B | | | | | B | | | | | | | |
| SELECTOR 54 | | | | A | | | | | | | B | | | | | B | | | | | | | | |
| MULTIPLIER 58 | | | | | X | | | | | | | X | | | | | X | | | | | | | |
| FILTERING REGISTER 55(READ/WRITE) | | | | R | | | | | R | | | | | R | | | | W | R | | | | W | |

-B : SUB「1」

FIG.10 A

| CLOCK | 0 | | | | | | | | 1 | . . . . . | 31 |
|---|---|---|---|---|---|---|---|---|---|---|---|
| | 0 | 1 | 2 | 3 | 4 | 5 | 6 | 7 | | | |
| SELECTOR 51 | | A | | B | | | -B | C | | | |
| SELECTOR 52 | | A | | A | | | A | B | | | |
| FULL ADDER 57 | X | | X | | X | | | X | | | |
| SELECTOR 53 | B | | | B | C | | | | " | . . . . . | " |
| SELECTOR 54 | | | B | A | | | | B | | | |
| MULTIPLIER 58 | X | | | X | X | | | | | | |
| FILTERING REGISTER 55(READ/WRITE) | R | W | R | R | | R | W | | | | |

FIG.10 B

| CLOCK | 0 | | | | | | | | 1 | | | | | | | | 2 | | | | | | | |
|---|---|---|---|---|---|---|---|---|---|---|---|---|---|---|---|---|---|---|---|---|---|---|---|---|
| | 0 | 1 | 2 | 3 | 4 | 5 | 6 | 7 | 0 | 1 | 2 | 3 | 4 | 5 | 6 | 7 | 0 | 1 | 2 | 3 | 4 | 5 | 6 | 7 |
| SELECTOR 51 | | | | | | B | | | B | | B | | B | | | | | | | | | | | |
| SELECTOR 52 | | | | | | I | | | D | | C | | C | | | | | | | | | | | |
| FULL ADDER 57 | | | | | | | X | | | X | | X | | X | | | | | | | | | | |
| SELECTOR 53 | | | D | | | D | | D | | D | | | | | | | | | | | | | | |
| SELECTOR 54 | | C | | | C | | C | | C | | | | | | | | | | | | | | | |
| MULTIPLIER 58 | | | X | | | X | | X | | X | | | | | | | | | | | | | | |
| FILTERING REGISTER 56(READ/WRITE) | | R | | | R | | R | | R | | | | | | | W | | | | | | | | |

X: EMPLOYING OPERATOR

FIG.11

| CLOCK | 0 | | | | | | | | 1 | | | | | | | | 2 | | | | | | | |
|---|---|---|---|---|---|---|---|---|---|---|---|---|---|---|---|---|---|---|---|---|---|---|---|---|
| | 0 | 1 | 2 | 3 | 4 | 5 | 6 | 7 | 0 | 1 | 2 | 3 | 4 | 5 | 6 | 7 | 0 | 1 | 2 | 3 | 4 | 5 | 6 | 7 |
| SELECTOR 51 | | | | | | B | | | B | | B | | B | | | | | | | | | | | |
| SELECTOR 52 | | | | | | / | | | D | | / | | C | | | | | | | | | | | |
| FULL ADDER 57 | | | | | | | X | | | X | | X | | X | | | | | | | | | | |
| SELECTOR 53 | | | D | | | D | | D | | D | | | | | | | | | | | | | | |
| SELECTOR 54 | | C | | | C | | C | | C | | | | | | | | | | | | | | | |
| MULTIPLIER 58 | | | X | | | X | | X | | X | | | | | | | | | | | | | | |
| FILTERING REGISTER 56(READ/WRITE) | | R | | | R | | R | | R | | | W | | | | W | | | | | | | | |

X:EMPLOYING OPERATOR
/:UNSELECTED

FIG.12

DIGITAL SIGNAL PROCESSING APPARATUS FOR APPLYING EFFECTS TO A MUSICAL TONE SIGNAL

FIELD OF THE INVENTION

The present invention relates to a digital signal processing apparatus which simultaneously applies various effects such as reverberation and chorus and the like with respect to a digital musical tone signal generated in an electronic musical instrument.

BACKGROUND ART

Conventional examples of this type of digital signal processing apparatus include, for example, the effector disclosed in Japanese Patent Publication No. Hei 1-19593. This effector comprises a plurality of operators such as multipliers and adders. This apparatus applies reverberation and modulation effects such as chorus, flanger, and the like, with respect to a digital musical tone signal which is generated. In this type of apparatus, during, for example, one sampling period, after modulation effects have been applied, reverberation is applied. That is to say, in this type of apparatus, in the case in which a plurality of effects are applied to a digital musical tone signal, the processing for applying the various "effects" is conducted in order and consecutively.

Accordingly, in such a conventional effector, while processing for the application of a given "effect" is being conducted, it is not possible to conduct processing for the application of a second "effect". As a result, the waiting period of the operators becomes large, and the effective efficiency of use of the operators worsens. In addition, as processes for the application of effects are executed in series, high speed processing is not possible.

SUMMARY OF THE INVENTION

It is accordingly an object of the present invention to provide a digital signal processing apparatus capable of increasing the efficiency of use of the operators, and capable of conducting high speed processing even in cases in which a plurality of effects are to be applied.

Accordingly, the present invention is a digital signal processing apparatus for conducting filtering and applying reverberation with respect to a generated musical tone signal, and is provided with:

a designating mechanism for generating filtering designation data, which designate the contents of the above filtering, reverberating designation data, which designate the contents of the above reverberation, and characteristics data, which express the combined contents of the above filtering and the above reverberation, a parameters generating mechanism for generating filtering parameters which express filtering characteristics in accordance with the above filtering designation data, and for generating reverberating parameters expressing reverberation characteristics in accordance with the above reverberating designation data and the above characteristics data, a readout mechanism provided with a memory mechanism which stores a plurality of operating algorithms, for reading a first operating algorithm, which designates the above filtering designation data, and a second operating algorithm, which designates the above reverberating designation data, out of the memory mechanism, a computing mechanism which possesses a plurality of adding mechanisms, multiplying mechanisms, and delaying mechanisms, forms a digital filter having characteristics in accordance with the above filtering parameters and comprising a combination of the above plurality of adding mechanism, multiplying mechanisms, and delaying mechanisms based on the above first operating algorithm, forms an operating unit having reverberation characteristics in accordance with the above reverberating parameters, and comprising a combination of the above plurality of adding mechanisms, multiplying mechanisms, and delaying mechanisms based on the above second operating algorithm, conducts time-shared operating of the digital filter and the operating unit, and conducts parallel processing of the filtering and the reverberation.

In accordance with this type of composition, the designating mechanism generates the filtering designation data, which designate the contents of the filtering, the reverberating designation data, which designate the contents of the reverberation, and the characteristics data, which indicate the contents of a combination of the filtering and the reverberation. The parameters generating mechanism generates filtering parameters indicating filtering characteristics, and reverberating parameters indicating reverberation characteristics. The readout mechanism reads the first operating algorithm, which designates filtering designation data, and the second operating algorithm, which designates reverberating designation data, out of the memory mechanism, in which a plurality of operating algorithms are stored. The computing mechanism forms a digital filter having characteristics in accordance with the filtering parameters, based on the first operating algorithm, and further forms an operating unit having reverberation characteristics in accordance with the reverberating parameters, based on the second operating algorithm, and conducts time shared operating of this digital filter and operating unit, and conducts parallel processing of filtering and reverberation.

Accordingly, as the digital filter which conducts the filtering of a musical tone signal, and the operating unit which applies reverberation to the musical tone signal, are operated in parallel, the efficiency of use of the operators can be increased, and processing can be accomplished rapidly, even in the case in which a plurality of effects are to be applied.

BRIEF DESCRIPTION OF THE DRAWINGS

FIGS. 10A and 10B are timetables showing the control contents of operating unit A.

FIGS. 11 and 12 are timetables showing the control contents of operating unit B.

DETAILED DESCRIPTION OF THE PREFERRED EMBODIMENTS (First Preferred Embodiment)

Hereinbelow, preferred embodiments of the present invention will be explained with reference to the drawings. The digital signal processing apparatus explained in the present preferred embodiment is used in a digital musical instrument as an effector for conducting a filtering process and a reverberation effecting process which will be explained hereinbelow.

(1) Overall Composition

Figure 1:
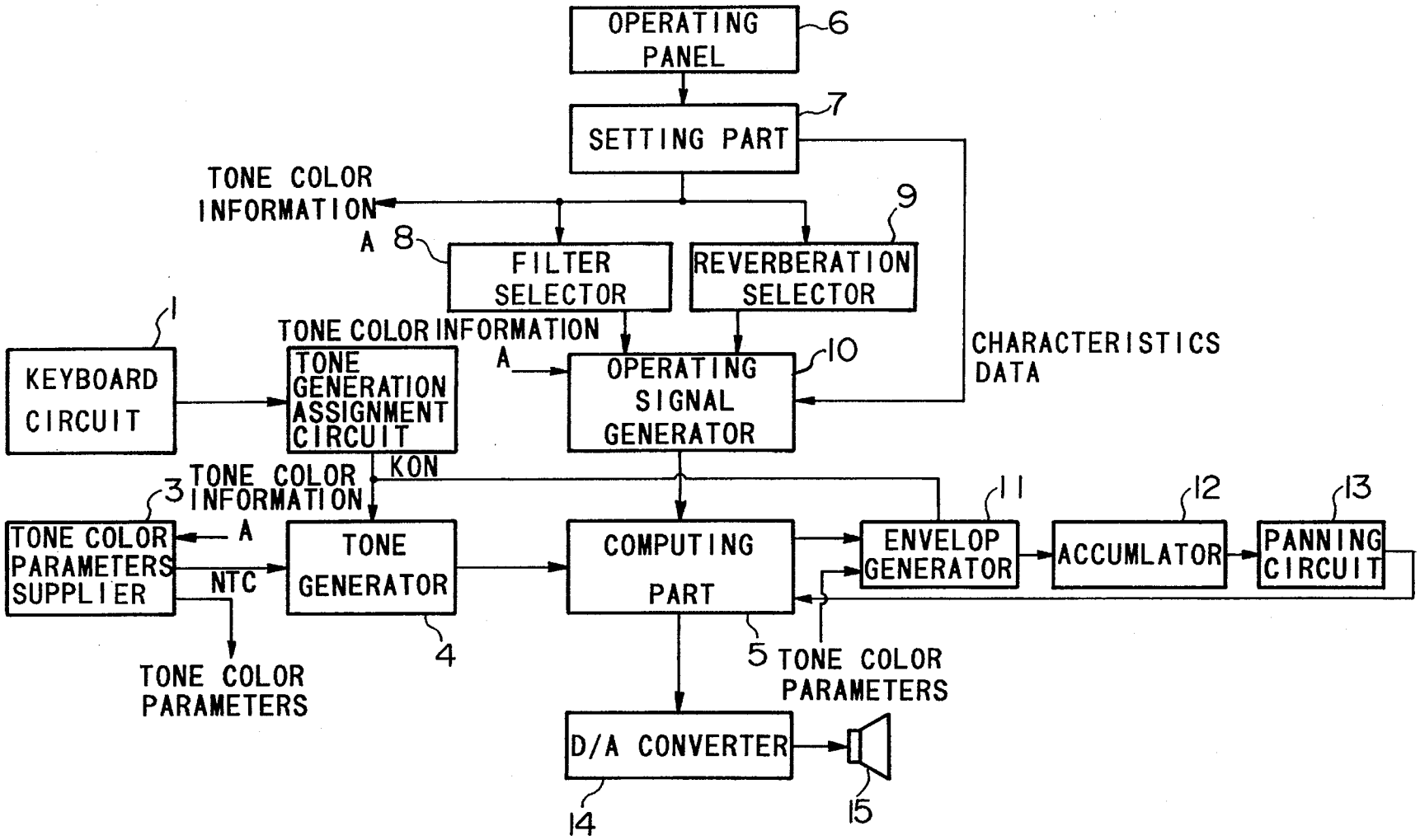
FIG. 1 is a block diagram showing the composition of a digital musical instrument in accordance with a preferred embodiment of the present invention.

FIG. 1 is a block diagram showing the composition of an electronic musical instrument utilizing a digital signal processing apparatus in accordance with the present invention. In the figure, reference numeral 1 indicates a keyboard circuit. This keyboard circuit 1 generates key-on signals KON, key codes KC, and key-off signals KOFF, and the like, in accordance with the operation of the keyboard by a performer. Reference numeral 2 indicates a tone generation assignment circuit, which assigns the musical tone signal generated in correspondence with the depression of a key to any of a plurality of tone generation channels. The digital musical instrument in accordance with the present invention possesses 32 tone generating channels.

Reference numeral 3 indicates a tone color parameters supplier, which supplies tone color parameters related to musical tones to be generated. This tone color parameters supplier 3 generates, for example, tone color codes NTC indicating tone color (a piano tone, organ tone, violin tone, or the like) from tone color information A, which is described hereinbelow, and generates tone color parameters indicating information relating to tone colors other than those expressed by tone color codes NTC.

Reference numeral 4 indicates a tone generator. Tone generator 4 is provided with 32 tone generation channels 0–31 ch, and generates digital musical tone signals with respect to each tone generation channel by means of time shared operating. Reference numeral 5 indicates a computing part; this conducts filtering with respect to musical tone signals supplied by tone generator 4, and conducts reverberation with respect to the output signals of a panning circuit 13, to be explained hereinbelow, in parallel and in a time-shared manner. This computing part 5 will be explained in detail hereinbelow.

Reference numeral 6 indicates an operation panel comprising a plurality of operating members; it generates setting information in accordance with setting operations applied to these operating members, and supplies this setting information to setting part 7. In operation panel 6, various switches which are not indicated in the diagram are provided; for example, tone color selecting switches, and various switches for setting filtering characteristics or reverberation effecting. Setting part 7 transforms the setting information by means of the tone color information A indicating tone color numbers, and outputs this. Furthermore, setting part 7 creates characteristics data in accordance with the combined contents of the filtering characteristics and the reverberation, and supplies these data to operating signal generator 10.

Filter selector 8 creates address signals which are necessary for the readout of the control program which executes filtering, based on tone color information A from setting part 7, and supplies these address signals to operating signal generator 10. Reverberation selector 9 creates address signals which are necessary for the readout of the control program which executes reverberation effecting, based on tone color information A from setting part 7, and supplies these address signals to operating signal generator 10. Operating signal generator 10 designates the operations of the above described computing part 5; the composition thereof will be explained hereinbelow.

Next, the musical tone signals of the 32 channels, the filtering of each of which is conducted in computing part 5, are severally supplied to envelope generator 11. Envelope generator 11 generates an envelope waveform, multiplies this by an inputted musical tone signal, and outputs the result. The musical tone signals having envelope waveforms applied thereto in this manner are then supplied to accumulator 12, and accumulated.

Reference numeral 13 indicates a panning circuit; it splits an inputted signal into a stereo left signal and right signal, and supplies these to computing part 5. Reverberation effects are applied to the left signal and the right signal in computing part 5, and these signals are converted to analog signals in digital/analog converter 14. Then, these analog signals are generated as musical tones as the output of the digital musical instrument through the medium of two differing speakers 15.

(2) Composition of Operating Generator 10

Next, with reference to FIG. 2, the composition of operating generator 10 will be explained. The address signals generated by filter selector 8 are supplied to filtering parameters supplier $\mathbf{20}_1$ and readout control circuit $\mathbf{21}_1$. Filtering parameters supplier $\mathbf{20}_1$ generates the parameters FLT-Q, FLT-fc, and address FLT-ad, which are used in filtering, from tone color information A and the address signals; it then modifies these parameters and address so as to be synchronous with key-on signal KON and supplies these to computing part 5 (see FIG. 1). Parameter FLT-Q indicates the resonance value of the filter, parameter FLT-fc indicates the cut-off frequency of the filter, and furthermore, address FLT-ad indicates the address signal necessary in the filtering operation.

Reference numeral $\mathbf{22}_1$ indicates a filtering control signal memory. This memory $\mathbf{22}_1$ stores a plurality of control programs $P1_l$, $P1_2$, . . . , which execute filtering. Control programs $P1_1$, $P1_2$, . . . , conduct the time sharing control of the selection of various selectors and the readout and writing of various registers in computing part 5. Readout control circuit $\mathbf{21}_1$ reads, in order, control programs corresponding to address signals out of filter selector 8.

The address signals generated by reverberation selector 9 are supplied to reverberating parameters supplier $\mathbf{20}_2$ and readout control circuit $\mathbf{21}_2$. The reverberating parameters supplier $\mathbf{20}_2$ generates the reverberation parameters REV-COEF and REV-VOL, as well as the address REV-ad, from the address signals, characteristics data, and tone color information A, and supplies these parameters and address to computing part 5. Parameter REV-COEF expresses a reverberating operation coefficient, while parameter REV-VOL expresses the size of the reverberating output. Address REV-ad indicates an address signal necessary in the reverberating operation.

Reference numeral $22_2$ indicates a reverberating control signal memory. This memory $22_2$ stores a plurality of control programs $P2_1$, $P2_2$, . . . , which execute reverberation. The control programs $P2_1$, $P2_2$, . . . , conduct the time shared control of the selection of the various selectors and the readout and writing of various registers in computing part 5. Readout control circuit $21_2$ reads out, in order, control programs corresponding to address signals supplied by reverberation selector 9. Accordingly, computing part 5 operates based on the control programs read out by means of the above readout control circuits $21_1$ and $21_2$.

(3) Composition of Computing Part 5

Figure 3:
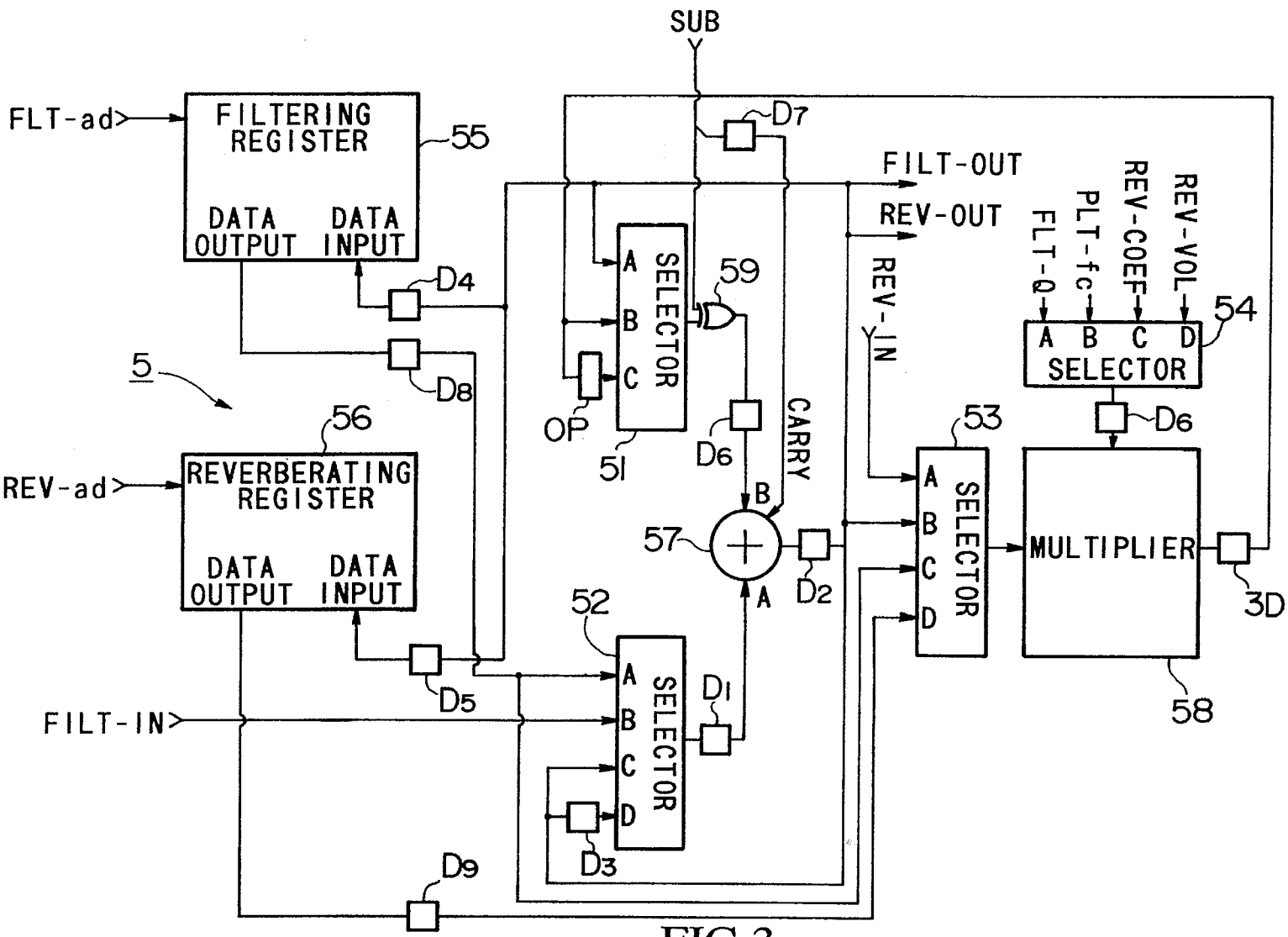
FIG. 3 is a block diagram showing the composition of computing part 5 in the same preferred embodiment.

Next, with reference to FIG. 3, the composition of computing part 5 will be explained. Computing part 5 executes filtering with respect to musical tone signals which are supplied to input terminal FILT-IN, and applies reverberation effects with respect to musical tone signals which are supplied to input terminal REV-IN. Computing part 5 is comprising selectors 51–54, filtering register 55, reverberating register 56, full adder 57, and multiplier 58.

As stated above, the selecting control of selectors 51– 54 and the readout/write control of filtering register 55 and reverberating register 56 is conducted by means of operating signal generator 10. The addresses used at the time of readout and writing in filtering register 55 and reverberating register 56 are designated by means of address FLT-ad supplied from reverberating parameter supplier $20_1$, and by address REV-ad supplied from reverberating parameters supplier $20_2$. References $D_1$–$D_9$ indicate delay elements which delay input of signals for a period corresponding to 1 sampling clock and then output these signals; reference 3D indicates a delay element having a delay period corresponding to 3 sampling clocks. What is meant by "1 sampling clock" here is a period corresponding to 1/256 of the sampling period T of the digital musical instrument (this will be explained in detail hereinbelow).

The musical tone signal supplied to input terminal FILT-IN is supplied to input terminal B of selector 52. The output of selector 52 is inputted to input terminal A of full adder 57 through the medium of delay element $D_1$. The output of full adder 57 is supplied to envelope generator 11 (see FIG. 1) from output terminal FILT-OUT thorough the medium of delay element $D_2$, and is supplied to digital/analog converter 14 (see FIG. 1) through the medium of output terminal REV-OUT. Furthermore, the output of full adder 57 is supplied to the input terminal A of selector 51, is supplied to the input terminal C of selector 52, is supplied to the input terminal D of selector 52 through the medium of delay element $D_3$, is supplied to input terminal B of selector 53, is supplied to the data input terminal of filtering register 55 through the medium of delay element $D_4$ and is supplied to the data input terminal of reverberating register 56 through the medium of delay element $D_5$.

The above-described parameters FLT-Q, FLT-fc, REV-COEF, and REV-VOL are inputted into the input terminals A, B, C, and D, respectively, of selector 54. The output of selector 54 is supplied to multiplier 58 through the medium of delay element $D_6$ as a multiplication coefficient. The output of selector 53 is inputted into multiplier 58, and the output of selector 54, that is to say, the above-described multiplication coefficient, is multiplied thereby. The output of multiplier 58 is delayed by 3 sampling clocks in delay element 3D, and is then supplied to input terminal B of selector 51, and is supplied to input terminal C of the same selector after being amplified by 6 dB in amplifier OP.

The output of selector 51 is supplied to one input terminal of exclusive-OR gate 59. Furthermore, an adder-subtractor control signal SUB having a value of 0 or 1 is supplied to the other input terminal of exclusive-OR gate 59 from operating signal generator 10. This adder-subtractor control signal SUB includes the control signals outputted from the above described readout control circuits $21_1$ and $21_2$.

Exclusive-OR gate 59 outputs the exclusive-or value of the output of selector 51 and adder-subtractor control signal SUB. The output of this exclusive-OR gate 59 is supplied to input terminal B of full adder 57 through the medium of delay element $D_6$. A 1-bit signal within adder-subtractor control signal SUB is inputted into full adder 57 though the medium of delay element $D_7$ as a carry signal (carrying-over signal). By means of this, full adder 57 adds the signals supplied to input terminal A and input terminal B and outputs this value when each bit of adder-subtractor control signal SUB has a value of 0. On the other hand, when each bit of adder-subtractor control signal SUB has a value of 1, the signal supplied to input terminal B is subtracted from the signal supplied to input terminal A, and the result is outputted.

The above-described left signal and right signal are supplied to input terminal A of selector 53 through the medium of input terminal REV-IN. Next, the data read out of filtering register 55 are supplied to input terminal A of selector 52 and input terminal C of selector 53 through the medium of delay element $D_8$. The data read out of reverberating register 56 are supplied to input terminal D of selector 53 through the medium of delay element $D_9$.

Figure 2:
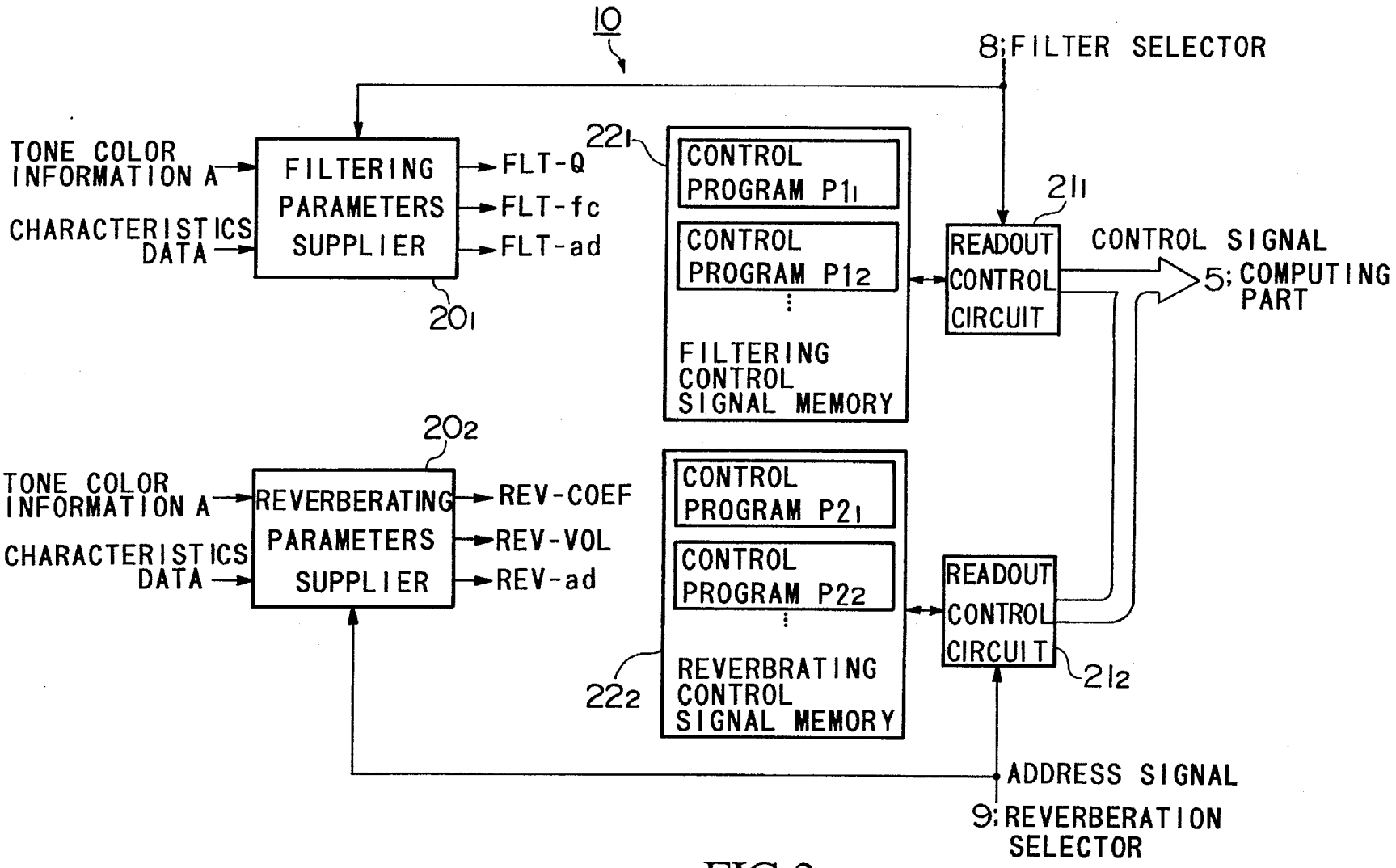
FIG. 2 is a block diagram showing the composition of operating signal generator 10 in the same preferred embodiment.

The addresses FLT-ad and REV-ad, which indicate addresses used at the time of readout/writing, are supplied to filtering register 55 and reverberating register 56 from filtering parameters supplier $20_1$ and reverberating parameters supplier $20_2$, which are shown in FIG. 2.

The computing part 5 having the above composition functions as a "digital filter" and a "reverberation effecting circuit" in a time-shared manner. That is to say, the computing part 5 executes filtering with respect to the musical tone signals of the 32 channels supplied by tone generator 4, and simultaneously, applies predetermined reverberation with respect to the output signals of panning circuit 13.

(4) Composition of the Digital Filter

Figure 4:
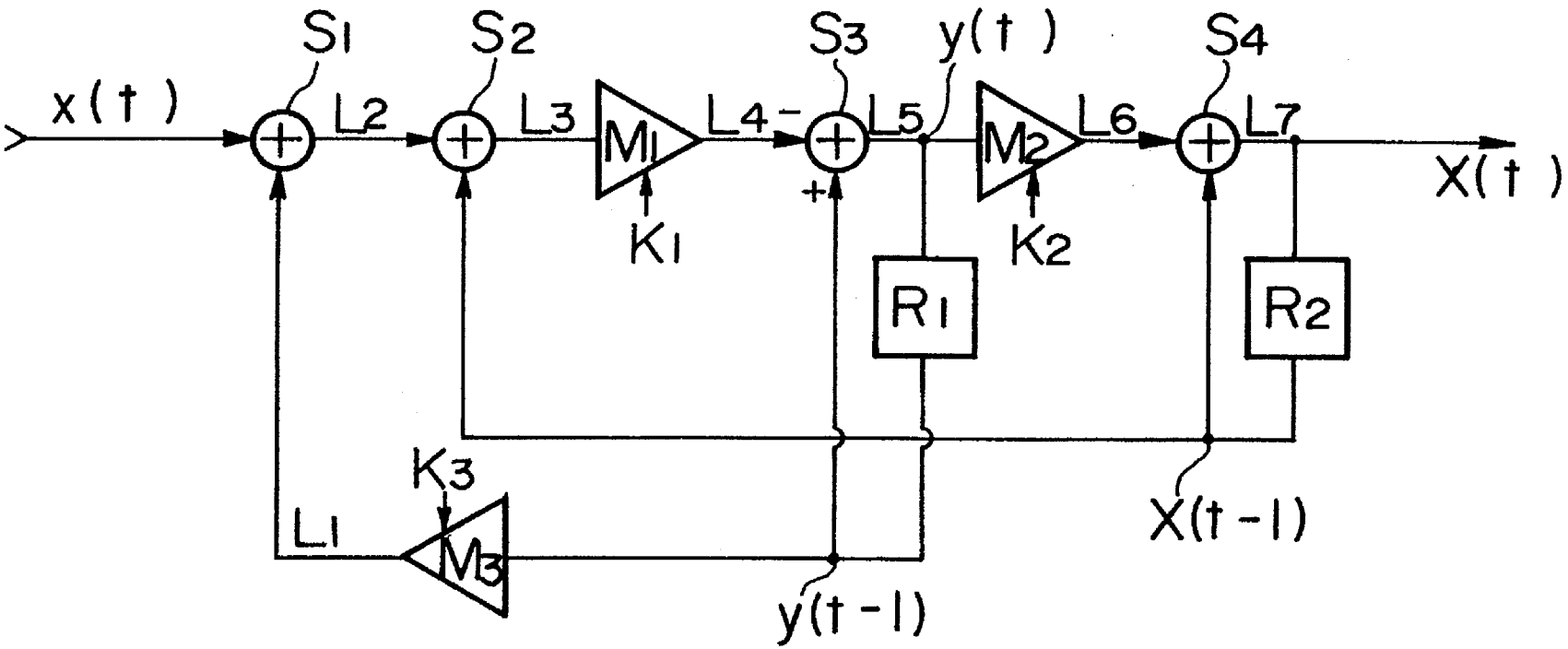
FIG. 4 is a block diagram showing the composition of the digital filter, which is operated in a time shared manner, in computing part 5.

Next, the composition of the "digital filter", which is formed in a time-shared manner in computing part 5, will be explained with reference to FIG. 4. In FIG. 4, references $S_1$–$S_4$ indicate adders, and references $M_1$–$M_3$ indicate multipliers having multiplication coefficients $K_1$–$K_3$. Furthermore, references $R_1$ and $R_2$ indicate delays, which have delay periods corresponding to the sampling period T of the digital musical instrument. These delays $R_1$ and $R_2$ are realized by means of addressing to filtering register 55 in computing part 5 (this will be explained in detail hereinbelow).

First, the input signal x(t) (t indicates a number 0, 1, 2, . . . , corresponding to each sampling period) of the digital filter is added to the multiplication result $L_1$ of multiplier $M_3$ in adder $S_1$, and furthermore, the addition result $L_2$ thereof is added to the delay result of delay $R_1$ in adder $S_2$. In addition, the addition result $L_3$ of adder $S_2$ is multiplied by coefficient $K_1$ in multiplier $M_1$, and the multiplication result $L_4$ thereof is supplied to the subtraction input terminal (–) in adder $S_3$. The addition result $L_5$ of adder $S_3$ is multiplied by coefficient $K_2$ in multiplier $M_2$, and the multiplication result $L_6$ thereof is supplied to one input terminal of adder $S_4$, and is supplied to the addition input terminal (+) of adder $S_3$ and to the input terminal of multiplier $M_3$ through the medium of delay $R_1$.

In addition, the addition result $L_7$ of adder $S_4$ is outputted as output signal X(t), to which filtering has been applied by means of the digital filter, and is returned to the other input terminal of adder $S_4$ and to the other input terminal of adder $S_2$ through the medium of delay $R_2$.

In the digital filter having this composition, if the addition result of adder $S_3$ is y(t), the delay results of delays $R_1$ and $R_2$ can be expressed as y(t−1) and X(t−1), and furthermore, it is possible to express the various output data in the following manner.

(1) Multiplication result $L_1$ of multiplier $M_3 = K_3 \cdot y(t-1)$ (Equation 1)

(2) Addition result $L_2$ of adder $S_1 = L_1 + X(t)$ (Equation 2)

(3) Addition result $L_3$ of adder $S_2 = L_2 + X(t-1)$ (Equation 3)

(4) Multiplication result $L_4$ of multiplier $M_1 = K_1 \cdot L_3$ (Equation 4)

(5) Addition result $L_5$ of adder $S_3 = y(t) = y(t-1) - L_4$ (Equation 5)

(6) Multiplication result $L_6$ of multiplier $M_2 = K_2 \cdot y(t) = K_2 \cdot L_5$ (Equation 6)

(7) Addition result $L_7$ of adder $S_4 = X(t) = L_6 + X(t-1)$ (Equation 7)

(5) Composition of the Reverberation Effecting Circuit

Next, the composition of the reverberation effecting circuit which is formed in a time-shared manner in computing part 5 will be explained with reference to FIG. 5. In the drawing, the reverberation effecting circuit is comprising generally initial reflecting tone generator 60 and reverberating tone generator 61. This initial reflecting tone generator 60 forms an initial reflecting tone which indicates the first half portion of the reverberation characteristics which are to be simulated. In contrast, reverberating tone generator 61 forms a final reverberating tone which indicates the second half portion of the reverberation characteristics, which continue after the initial reflecting tone, which are to be simulated.

Figure 5:
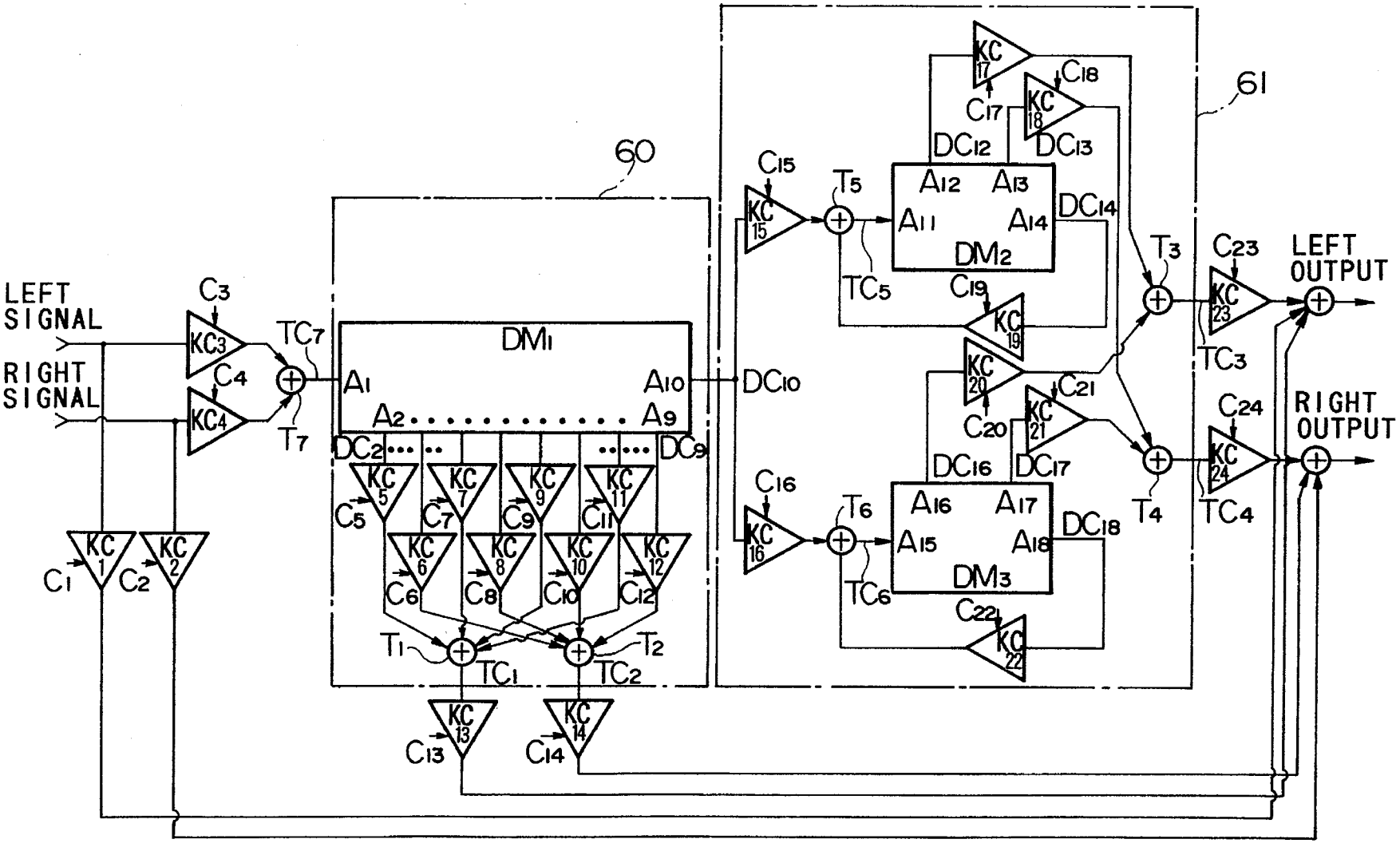
FIG. 5 is a block diagram showing the composition of a reverberation effecting circuit, which is operated in a time shared manner in computing part 5.

In FIG. 5, references $KC_1$–$KC_{24}$ indicate multipliers which multiply inputted signals by coefficients $C_1$–$C_{24}$, respectively, and output these values. References $T_1$–$T_7$ indicate adders which output addition results $TC_1$-$T_7$, respectively. Furthermore, references $DM_1$–$DM_3$ indicate delays which delay inputted signals by a predetermined delay time before outputting these signals. Delays $DM_1$–$DM_3$ are comprising a single type of shift register, respectively, and shift the written data in order in each sampling period T.

Accordingly, in delay $DM_1$, addition result $TC_7$ is written into address $A_1$, and after a predetermined delay period has elapsed, this is read in addresses $A_2$–$A_{10}$, and thereby delay data $DC_2$–$DC_{10}$ having a predetermined delay time with respect to addition result $TC_7$ can be generated. In the same way, in delays $DM_2$ and $DM_3$, the addition results $TC_5$ and $TC_6$ are written into addresses $A_1$ and $A_2$ respectively, and after a predetermined delay period has elapsed, these are read in addresses $A_{12}$–$A_{14}$ and addresses $A_{16}$–$A_{18}$, and thereby, it is possible to generate delay data $DC_{12}$–$DC_{14}$ and delay data $DC_{16}$–$DC_{18}$, which have a predetermined delay period with respect to addition results $TC_5$ and $TC_6$. A detailed description thereof will be given hereinbelow.

Figure 6:
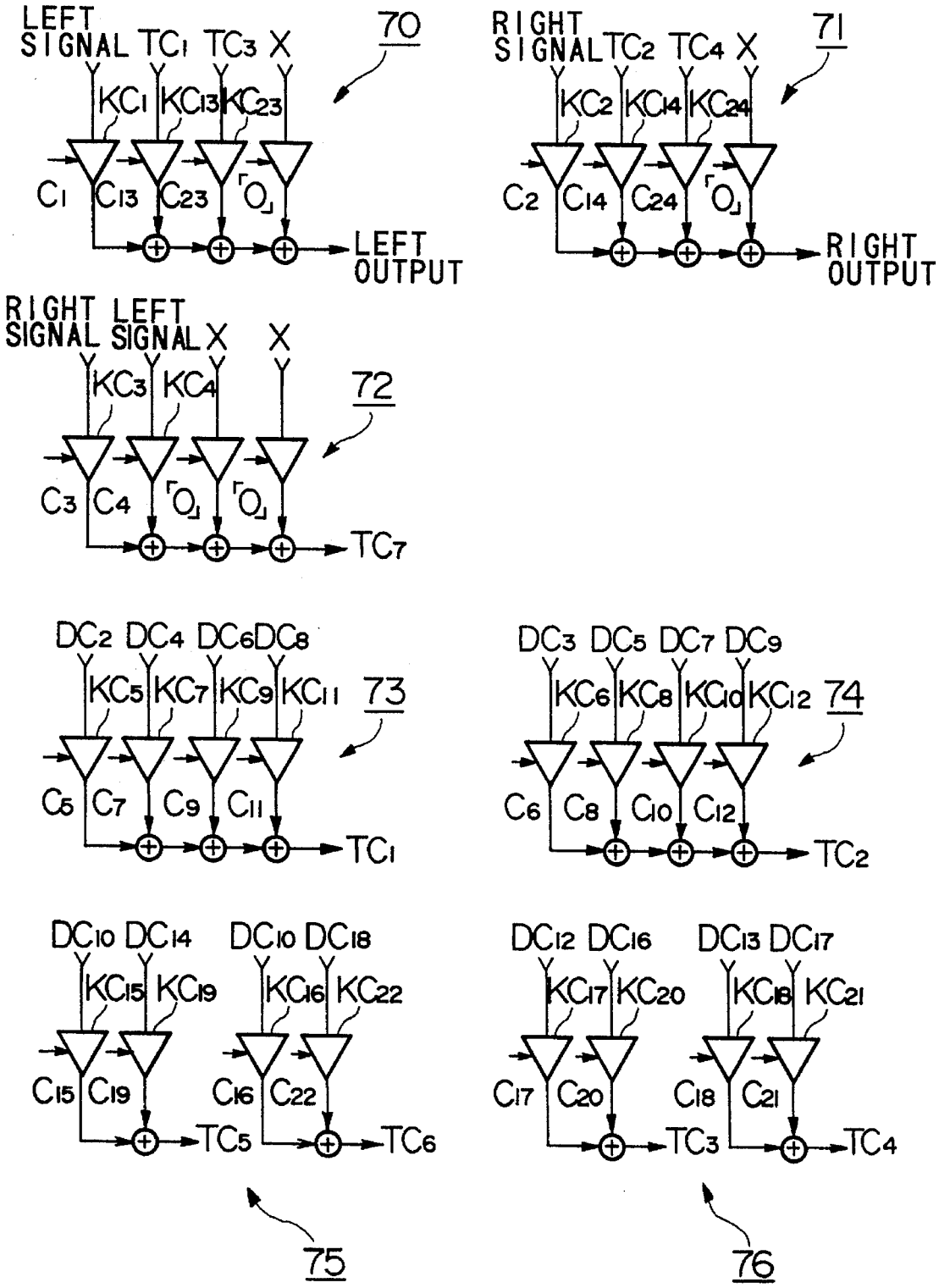
FIG. 6 is a block diagram showing the composition of the reverberation effecting circuit shown in FIG. 5, when this is divided into operating units.

The reverberation effecting circuit shown in FIG. 5 can be divided into the operating units 70–76 shown in FIG. 6. The operations of these operating units 70–76 are executed within a sampling period T, and thereby, it is possible to conduct reverberation effecting.

The addition results $TC_1$–$TC_4$ in operating units 72–76 are temporarily stored in reverberating register 56 (see FIG. 5); and addition results $TC_5$–$TC_7$ are stored in the same register in order to generate delay data. Furthermore, in operating units 70–72, when the input consists of "X", this indicates that nothing is inputted; however, a multiplication coefficient "0" is supplied so that the output of the corresponding multiplier becomes "0". These operating units 70–76 can be further divided into either operating units A or operating units B, which will be described next.

Figure 7:
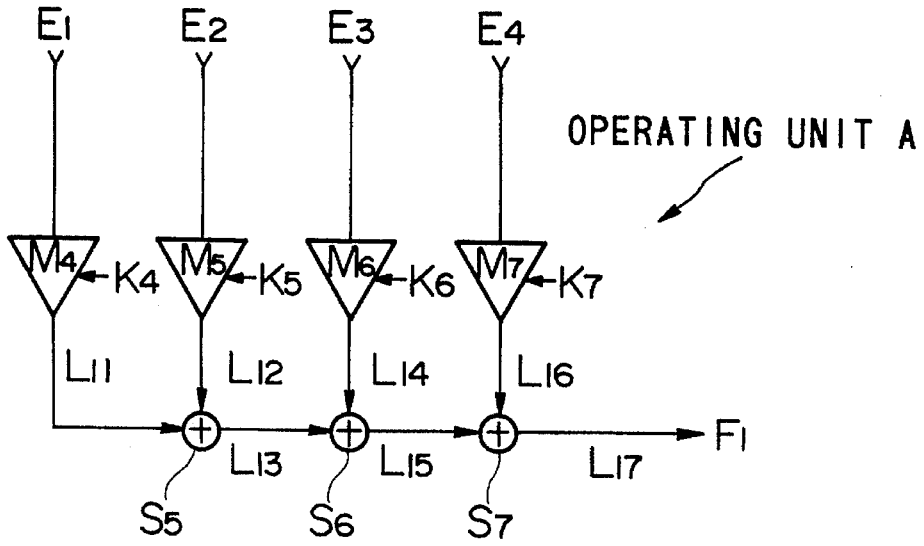
FIG. 7 is a block diagram showing the composition of the operating unit shown in FIG. 6.
Figure 8:
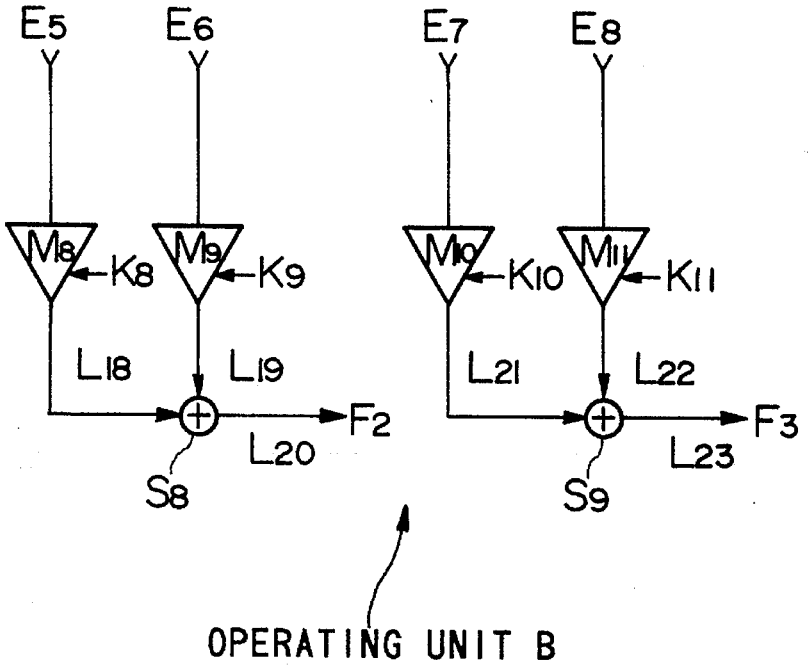
FIG. 8 is a diagram showing a timetable of the filtering and reverberation effecting process which is executed for each tone generation channel 0 ch–31 ch within a sampling period T.

FIG. 7 is a block diagram showing the composition of an operating unit A; this corresponds to operating units 70–74 in FIG. 6. In the same manner, FIG. 8 is a block diagram showing the composition of an operating unit B; this corresponds to operating units 75 and 76 in FIG. 6. By operating these operating units A and B in order, the reverberating effecting circuit shown in FIG. 5 can be equivalently formed.

Next, the composition of the operating unit A which corresponds to operating units 70–74 will be explained. As shown in FIG. 7, input data $E_1$ is multiplied by multiplication coefficient $K_4$ by means of multiplier $M_4$ and the multiplication result $L_{11}$ thereof is supplied to one input terminal of adder $S_5$. Furthermore, input data $E_2$ is multiplied by coefficient $K_5$ in multiplier $M_5$ and the multiplication result $L_{12}$ thereof is supplied to the other input terminal of adder $S_5$. Furthermore, in adder $S_5$, multiplication results $L_{11}$ and $L_{12}$ are added, and the addition result $L_{13}$ thereof is supplied to one input terminal of adder $S_6$. Input data $E_3$ is multiplied by coefficient $K_6$ in multiplier $M_6$, and the multiplication result $L_{14}$ is supplied to the other input terminal of adder $S_6$. In adder $S_6$, addition result $L_{13}$ and multiplication result $L_{14}$ are added, and the addition result $L_{15}$ thereof is supplied to one input terminal of adder $S_7$. Input data $E_4$ are multiplied by coefficient $K_7$ in multiplier $M_7$, and the multiplication result $L_{16}$ thereof is supplied to the other input terminal of adder $S_7$. In addition, in adder $S_7$, addition result $L_{15}$ and multiplication result $L_{16}$ are added, and the addition result $L_{17}$ thereof is outputted as output data $F_1$. That is to say, input data $E_1$–$E_4$ are multiplied by coefficients $K_4$–$K_7$, respectively, in multipliers $M_4$–$M_7$, and the sum of the multiplication results thereof is outputted as output data $F_1$.

The various data of the operating unit A shown in FIG. 7 correspond to differing data in the operating units 70–74 shown in FIG. 6. For example, the various data in operating unit A correspond in the following manner in operating unit 70.

That is to say, input data $E_1$ correspond to the left signal, input data $E_2$ and $E_3$ correspond to addition results $TC_1$ and $TC_3$, and furthermore, input data $E_4$ correspond to "X" (as explained above, nothing is inputted). Addition results $TC_1$ and $TC_3$ are temporarily stored in reverberating register 56, so that readout is conducted at the necessary timing. In addition, output data $F_1$ correspond to the left output, which is outputted to the digital/analog converter 14 as the left signal, to which reverberation has been applied.

In the same manner, the various data in operational unit A correspond in the following manner in operational unit 71. That is to say, input data $E_1$ correspond to the right signal, input data $E_2$ and $E_3$ correspond to the addition results $TC_2$ and $TC_4$, and furthermore, input data $E_4$ correspond to "X". In addition, output data $F_1$ correspond to the right output, and are supplied to the digital/analog converter (see FIG. 1).

Furthermore, the various data in operating unit A correspond in the following manner in operating units 72–74. That is to say, the input data $E_1$ in operating unit A correspond to the left signal and to the delay data $DC_2$ and $DC_3$, respectively, in operating units 72–74, input data $E_2$ correspond to the right signal and to delay data $DC_4$ and $DC_5$, respectively, input data $E_3$ correspond to "X", and to delay data $DC_6$ and $DC_7$, respectively, and furthermore, input data $E_4$ correspond to "X", and to delay data $DC_8$ and $DC_9$, respectively. Delay data $DC_2$–$DC_9$ are read out and supplied by means of the designation of predetermined addresses from reverberating register 56 (see FIG. 3). Furthermore, the output data $F_1$ in operating unit A correspond to addition results $TC_7$, $TC_1$, and $TC_2$, respectively, in operating units 72–74, and these are written into predetermined addresses in reverberating register 56.

Next, the composition of operating unit B, which corresponds to the operating units 75 and 76, will be explained.

As shown in FIG. 8, input data $E_5$ is multiplied by coefficient $K_8$ in multiplier $M_8$, and the multiplication result $L_{18}$ thereof is supplied to one input terminal of adder $S_8$. Furthermore, input data $E_6$ are multiplied by coefficient $K_9$ in multiplier $M_9$, and the result thereof is supplied to the other input terminal of adder $S_8$. Then, in adder $S_8$, the multiplication results $L_{18}$ and $L_{19}$ are added, and the addition result $L_{20}$ thereof is outputted as output data $F_2$. Input data $E_7$ and $E_8$ are multiplied by coefficients $K_{10}$ and $K_{11}$ in multipliers $M_{10}$ and $M_{11}$, respectively, and furthermore, multiplication results $L_{21}$ and $L_{22}$ are added in adder $S_9$, and the addition result $L_{23}$ thereof is outputted as output data $F_3$.

The input data $E_5$–$E_8$ in operating unit B correspond to delay data $DC_{10}$, $DC_{14}$, $DC_{10}$, and $DC_{18}$, respectively, in operating unit 75, which is shown in FIG. 6. In operating unit 76, these input data correspond to delay data $DC_{12}$, $DC_{16}$, $DC_{13}$, and $DC_{17}$, respectively. These delay data are read out of predetermined addresses in reverberating register 56. Furthermore, the output data $F_2$ and $F_3$ in operating unit B correspond to addition results $TC_5$ and $TC_6$, respectively, in operating unit 75. Furthermore, in operating unit 76, these output data correspond to addition results $TC_3$ and $TC_4$, respectively, and these addition results $TC_3$–$TC_6$ are written into predetermined registers in reverberating register 56.

Next, operations at the time of readout/writing of reverberating register 56, and the generating principle of the various delay data $DC_2$–$DC_{10}$, $DC_{12}$–$DC_{14}$, and $DC_{16}$–$DC_{18}$ by means of delays $DM_1$, $DM_2$, and $DM_3$, will be explained. The addition result $TC_7$ shown in FIG. 5 is written into address $A_1$ of delay $DM_1$. This indicates that the contents of the address REV-ad which was designated in reverberating register 56 in FIG. 3, has a value of "$A_1$". That is to say, the addition result $TC_7$ of operating unit 72 in FIG. 6 is written into address $A_1$ in reverberating register 56. In the same way, the addition results $TC_5$ and $TC_6$ of operating unit 75 are written into addresses $A_{11}$ and $A_{15}$ in reverberating register 56.

Next, the addition result $TC_7$ which is written in address $A_1$ is read into addresses $A_2$–$A_{10}$ in operating units 73–75 as delay data $DC_2$–$DC_{10}$. At this time, the relationship between address $A_1$ and addresses $A_2$–$A_{10}$ can be expressed in the manner shown below.

$A_2=A_1+d_2$, $A_3=A_1+d_3, \ldots,$ $A_{10}=A_1+d_{10}$.

Reverberating register 56 is a shift register which shifts the data stored therein in the direction of increase of the addresses during each sampling period T. That is to say, the addition result $TC_7$ written in address $A_1$ is moved to address $(A_1+1)$ after one sampling period. Accordingly, the delay data $DC_2$ which were read out of address $A_2$ $(=A_1+d_2)$ are data which delay addition result $TC_7$ by a period of time equivalent to $d_2\times$(sampling period T) . Furthermore, delay data $DC_3$–$DC_{10}$ are data which delay the addition results $TC_7$ by a period equivalent to $(d_3, d_4, \ldots, d_{10})\times$(sampling period T), respectively. The delaying principle of delays $DM_2$ and $DM_3$ is identical to that of $DM_1$.

Reverberating register 56 may be a pseudo-shift register, formed by means of the addressing of normal RAM. In such a case, a counter is present which reduces the final address value of reverberating register 56 by "1" each sampling period, and the result of this count is added to the addresses $A_1$–$A_{10}$. By means of this, even if it appears that writing/readout is being conducted in the same address, the actual address is moved in each sampling period.

On the other hand, the addition results $TC_1$, $TC_2$, $TC_3$, and $TC_4$ of operating units 73, 74, and 76 (see FIG. 6) are written into reverberating register 56 for the purpose of temporary storage. Here, the address given to address REV-ad is, respectively, $A_{19}$, $A_{20}$, $A_{21}$, and $A_{22}$. After the addition results $TC_1$–$TC_4$ have been written into addresses $A_{19}$–$A_{22}$, respectively, it is possible to read out the same addition results without delay if readout is conducted from the same addresses $A_{19}$–$A_{22}$ in the same sampling period. However, this occurs in the case in which writing and readout is conducted in that order in the same sampling period. In the case in which readout is first conducted and then writing is conducted, the data which are read out are those data which are written in the immediately previous sampling period; however, this does not present an obstacle in the case of reverberation.

Filtering register 55 comprises a shift register or a pseudo-shift register formed by means of RAM, and the operations at the time of readout/writing are identical to the operations of reverberating register 56.

(6) Outline of Operations

In a digital musical instrument having the composition described above, when a key on the keyboard is depressed by a performer, keyboard circuit 1 generates a key-on KON and a key code KC corresponding to the depressed key, and supplies this to tone generation assignment circuit 2. Next, tone generation assignment circuit 2 searches, in order, for empty channels in tone generator 4 which are capable of tone generation assignment, that is to say, channels which are in a tone generation stand-by status. At this time, tone generation assignment circuit 2 supplies key-on KON and key code KC with respect to an empty channel, when such a channel has been found, so that a musical tone signal will be generated. On the other hand, in the case in which no empty channel is present, the channel in which tone generation is most advanced is selected, a truncation process is conducted which forces this channel to become empty, and after a directive has been issued to this channel so that the present tone generation is caused to decay (damping process), key-on KON and key code KC are supplied. Here, key-on KON is provided to envelope generator 11.

Furthermore, tone color parameters supplier 3 creates various tone color parameters corresponding to the tone colors set by means of tone color information A, and supplies these parameters to tone generator 4 and envelope generator 11. Then, the channel in tone generator 4 which was assigned by means of tone generation circuit 2 generates a musical tone signal having a tone color corresponding to the tone color parameters which were supplied and having a pitch corresponding to key code KC, from the initialization of key-on KON. In this manner, differing musical signals corresponding to 32 channels are generated in tone generator 4.

Operating panel 6 supplies the setting information of the operating members thereof to setting part 7. Setting part 7 generates tone color information A showing a tone color number from this setting information, and supplies this to tone color parameter supplier 7, filter selector 8, reverberation selector 9, and operating signal generator 10. Furthermore, setting part 7 creates performance data based on the setting information from operating panel 6, and supplies this performance data to operating signal generator 10. Then, filter selector 8 and reverberation selector 9 create address signals of control programs which are to be read out, based on tone color information A.

That is to say, filter selector 8 selects the control program which is to be read out from among the plurality of control programs for filters $P_1$, $P_2$, . . . , by means of tone color information A, and furthermore, in accordance with the control sampling clock, the address of the control program is updated by a value of "1" each time. Here, if the size of one control program is 256 steps, the control sampling clock is supplied at periods corresponding to $1/256$ of sampling period T. That is to say, the cycle of one control program is completed in one sampling period. In the same manner, in reverberation selector 9, the control program which is to be read out is selected from among the plurality of control programs for reverberation $P2_1$, $P2_2$, . . . , by means of tone color information A, and in accordance with the control sampling clock, the control program address is updated by a value of "1".

In FIG. 2, filtering parameters supplier $\mathbf{20}_1$ supplies filtering parameters FLT-Q and FLT-fc in order based on tone color information A and in correspondence with address signals. These filtering parameters FLT-Q and FLT-fc are synchronized with the selected control program for filtering, and are supplied so as to correspond to the coefficients $K_1$–$K_3$ (see FIG. 4) for each channel.

In the same manner, reverberating parameters supplier $\mathbf{20}_2$ supplies reverberating parameters REV-COEF and REV-VOL in order based on tone color information A and performance data, in correspondence with address signals. These reverberating parameters REV-COEF and REV-VOL are synchronized with the selected control program for reverberation and are supplied, and are supplied in such a manner as to correspond to coefficients $K_4$–$K_{11}$ (see FIG. 7) for each channel.

Filtering based on the corresponding filtering parameters described above is conducted in computing part 5 with respect to the musical signals of the 32 channels which were generated by tone generator 4, and subsequently, these are multiplied by an envelope waveform in envelope generator 11. The signals which have been multiplied in this manner are first accumulated in accumulator 12, and then, in panning circuit 13, these signals are separated into a left signal and a right signal for the purpose of producing stereo. Thereupon, reverberation is applied to this left signal and right signal in computing part 5, and then these signals are converted to analog signals in digital/analog converter 14, and tone generation is conducted through the medium of speakers 15.

(7) Operation of Computing Part 5

In computing part 5, as explained above, filtering is conducted with respect to the musical tone signals of each tone generation channel generated by means of tone generator 4, and reverberation effecting is conducted with respect to the left and right signals divided by means of the panning circuit 13; these are conducted within one sampling period T and in a time shared manner and in parallel.

Figure 9:
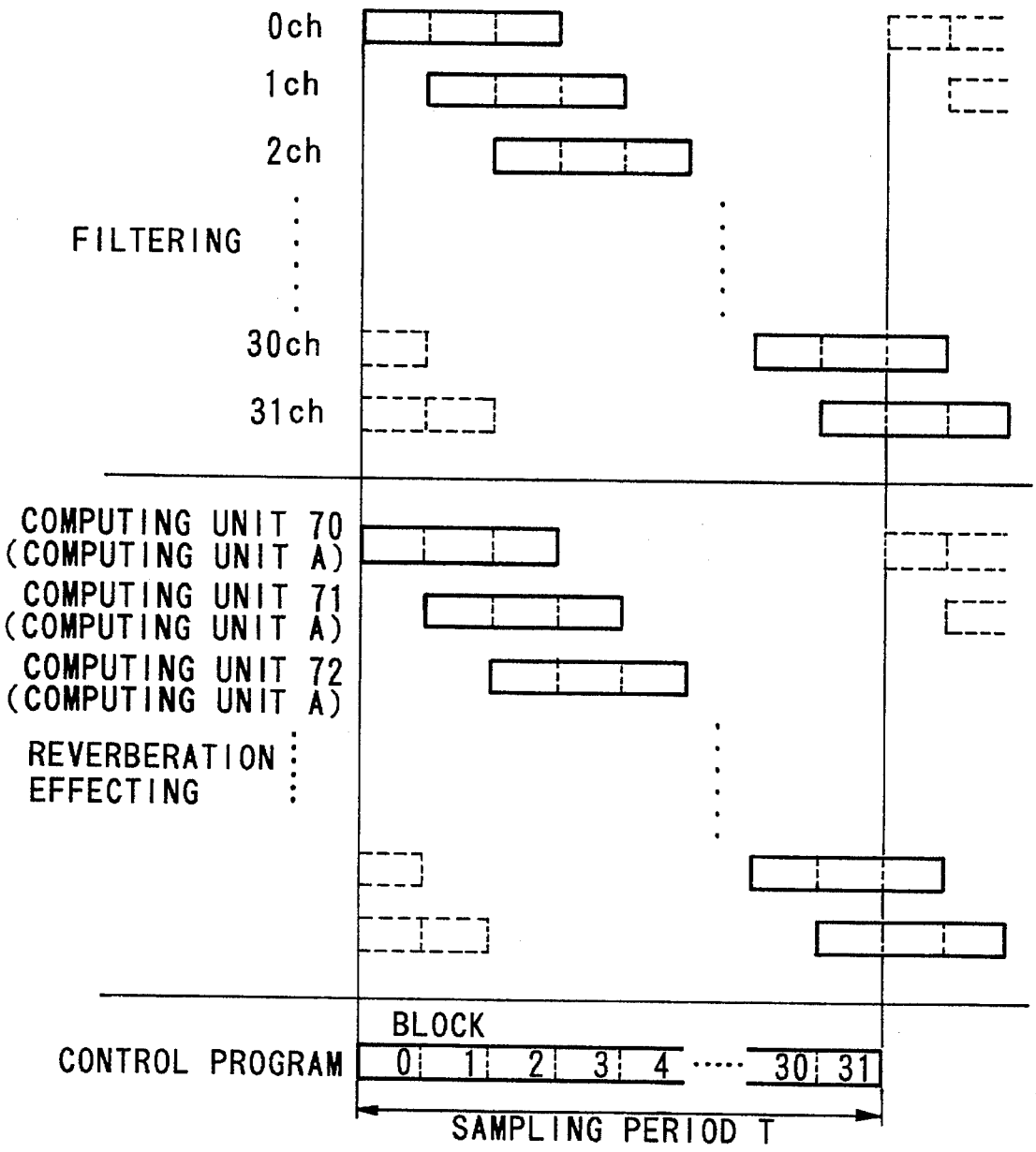
FIG. 9 is a timetable showing the contents of the filtering which is conducted in tone generation channel 0 ch.

FIG. 9 shows the execution timing of the filtering and the reverberation effecting executed in each tone generation channel within a sampling period T. As shown in the diagram, sampling period T is divided into 32 equal blocks. Numbers "0"–"31" corresponding to each tone generation channel are assigned to these blocks.

The filtering which is executed with respect to each tone generation channel 0–31 ch is conducted so as to be delayed by 1 block in a 3-block period. That is to say, the filtering conducted with respect to the musical tone signal in channel 0 ch is conducted during the 0–2 block period, and the filtering conducted with respect to the musical tone signal in a channel n ch (n represents an integer within a range of 0–31) is conducted so as to be delayed by 1 block with respect to the processing of the channel (n–1) ch.

The processing of each operating unit 70–76 which realizes reverberation effecting is conducted so as to be delayed by 1 block within a period of 3 blocks. That is to say, in reverberation effecting, first, the processing of the operating unit 70 using operating unit A is conducted in the 0–2 block period, and next, the processing of the operating unit 71 is conducted with a 1 block delay with respect to the processing of operating unit 70. Hereinafter, in the same manner, the processing of the operating unit 74 using operating unit A is conducted with a 1-block delay with respect to the operating unit 73. Next, the processing of the operating unit 75 using operating unit B is conducted with a 1-block delay with respect to the processing of the operating unit 74, and the processing of the operating unit 76 is conducted with a 1-block delay with respect to the operating unit 75.

The actual processing number of the operating units conducting reverberation effecting in a sampling period T is 32. However, in the example shown in the diagram, for the purposes of simplification of the explanation, the actual execution was limited to the 7 operating units 70–76 which were described above.

In conclusion, in a sampling period T, a control program comprising 32 consecutive blocks is executed. This control program is executed in such a manner that the filtering with respect to the musical tone signals of the channels 0–31 ch and the operations of operating units 70–76 are delayed by 1 block within a 3-block period, and are thus overlaid.

(8) Operation of the Digital Filter

Next, the operation of the digital filter which is formed in computing part 5 will be explained. In the explanation of this operation, the case in which filtering is executed with respect to the musical tone signal of the 0 ch channel will be used as an example. FIG. 10 shows a control program, which executes filtering with respect to the musical tone signal of the 0 ch shown in FIG. 9, as a timetable. Furthermore, to explain in greater detail, the selection of selectors 51–54 and the control of filtering register 55 in computing part 5 is expressed as a timetable. The adding timing of full adder 57 and the multiplication timing of multiplier 58 have no relationship to the operation of the control program; however, they are shown in the timetable in order to facilitate explanation.

As shown in FIG. 10, this control program comprises 3 blocks "0"–"2". Each block comprises 8 steps. Each step is executed in a 1-block period. As a result, in a sampling period 1 T, a control program having 256 (32 blocks×8 sampling clocks) steps is executed. Accordingly, in a sampling period 1 T, by supplying 256 sampling clocks, the control program is executed. In a sampling clock, the numbers "0"–"7" are applied in order to the blocks. Hereinbelow, in order to facilitate explanation, in the case in which, for example, the fifth sampling clock of the first block is indicated, this will be referred to as sampling clock 1-5.

Computing part 5 executes each operation [1]–[7] described below in accordance with the timetable shown in FIG. 10, and finds the operational results $L_1$–$L_7$ of the digital filter (see FIG. 4).

[1] Calculation of Multiplication Result $L_1$

First, as shown in FIG. 10, in sampling clock 0-3, address FLT-ad is supplied from filters parameter supplier $\mathbf{20}_1$ (see FIG. 2) as a readout address, and y(t–1), which is the delay data of delay $R_1$ (see FIG. 4) is read out of filtering register 55. This data y(t–1) was written as delay $R_1$ one sampling period prior to the present time t. That is to say, delays $R_1$ and $R_2$ are realized using filtering register 55, and by means of reading out the written data after period 1 T, the data are delayed by 1 sampling period T. The data y(t–1) are delayed by one sampling clock by means of delay element $D_8$ (see FIG. 3), so that these data are supplied to selector 53 during sampling clock 0-4.

Next, in sampling clock 0-4 (see FIG. 9), selector 53 selects input terminal C. By means of this, data y(t–1) are supplied to multiplier 58.

In sampling clock 0-3, selector 54 selects input terminal A. The data supplied to this input terminal A correspond to coefficient $K_3$ in FIG. 4, and in sampling clock 0-3, these data are parameter FLT-Q, which is supplied from filtering parameters supplier $\mathbf{20}_1$. These data are supplied to multiplier 58 during sampling clock 0-4 through the medium of delay element $D_6$.

Accordingly, during sampling clock 0-4, data y(t–1) and coefficient $K_3$ are supplied to multiplier 58 so that the multiplication result $L_1$ shown in equation 1 is calculated. Multiplication result $L_1$ is supplied to input terminal C of selector 51 through the medium of delay element 3D and amplifiers OP, in order. That is to say, multiplication result $L_1$ is amplified by +6 dB during sampling clock 0-7 and is supplied to input terminal C of selector 51.

[2] Calculation of Addition Result $L_2$

In sampling clock 0-7, selector 51 selects input terminal C, and selector 52 selects input terminal B. By means of the selection of selector 51, multiplication result $L_1$ is supplied to input terminal B of full adder 57 through the medium of exclusive-OR gate 59 and delay element $D_6$. Furthermore, the signal supplied to input terminal FILT-IN is digital filter input signal x(t), and by means of the selection of selector 52, this is supplied to input terminal A of full adder 57 through the medium of delay element $D_1$.

Here, multiplication result $L_1$ and input signal x(t) are supplied through the media of delay elements $D_6$ and $D_1$, respectively, so that they are supplied during sampling clock 1-0 to full adder 57. Accordingly, the addition result $L_2$ shown in equation 2 is calculated.

[3] Calculation of Addition Result $L_3$

Next, in sampling clock 1-1, selector 51 selects input terminal A. At this time, the addition result $L_2$ calculated by means of full adder 57 in sampling clock 1-0 is delayed by 1 sampling clock by means of delay element $D_2$ and is supplied to input terminal A of selector 51. By means of this, addition result $L_2$ is supplied to input terminal B of full adder 57 through the media of exclusive-OR gate 59 and delay element $D_6$.

In sampling clock 1-0, the data X(t–1) of delay $R_2$ which were written in the immediately previous sampling period are read out of filtering register 55. These data are delayed by 1 sampling clock by means of delay element $D_8$, so that they are supplied in sampling clock 1-1 to input terminal A of selector 52. In sampling clock 1-1, selector 52 selects input terminal A, so that data X(t–1) are supplied to input terminal A of full adder 57 through the medium of delay element $D_1$. That is to say, addition result $L_2$ and data X(t–1) are supplied through the medium of delay elements $D_6$ and $D_1$, respectively, so that they are supplied in sampling clock 1-2 to full adder 57. By means of this, the addition result $L_3$ shown in Equation 3 is calculated.

[4] Calculation of Multiplication Result $L_4$

Next, in sampling clock 1-3, selector 53 selects input terminal B. At this time, the addition result $L_3$ calculated by means of full adder 57 in sampling clock 1-2 is delayed by 1 sampling clock by means of delay element $D_2$ and is supplied to input terminal B of selector 53, so that this addition result is supplied to multiplier 58.

In sampling clock 1-2, selector 54 selects input terminal B. The data supplied to this input terminal B correspond to coefficient $K_1$ in FIG. 4, and are parameter FLT-fc, which is supplied from filtering parameters supplier $\mathbf{20}_1$ in sampling clock 1-2. These data are supplied in sampling clock 1-3 to multiplier 58 through the medium of delay element $D_6$.

Accordingly, in sampling clock 1-3, addition result $L_3$ and coefficient $K_1$ are supplied to multiplier 58, so that the multiplication result $L_4$ shown in Equation 2 is calculated. This multiplication result $L_4$ is outputted through the medium of delay element 3D, so that it is supplied to selector 51 in sampling clock 1-6.

[5] Calculation of Addition Result $L_5$

Next, in sampling clock 1-6, selector 51 selects input terminal B. As a result, multiplication result $L_4$ is supplied to input terminal B of full adder 57 through the medium of exclusive-OR gate 59 and delay element $D_6$. At this time, each bit of adder-subtractor control signal SUB acquires a value of "1", so that the subtraction processing of input terminal (A–B) is conducted in full adder 57. Furthermore, multiplication result $L_4$ is supplied through the medium of delay element $D_6$, so that it is delayed by 1 sampling clock from sampling clock 1-6 and is supplied to full adder 57 in sampling clock 1-7.

In sampling clock 1-5, the data y(t–1) of delay $R_1$ are again read out from filtering register 55. In sampling clock 1-6, selector 52 selects input terminal A. The data y(t–1) are supplied through the medium of delay elements $D_8$ and $D_1$ in order, so that these data are delayed by 2 sampling clocks from sampling clock 1-5, that is to say, they are supplied to input terminal B of full adder 57 in sampling clock 1-7.

Accordingly, in sampling clock 1-7, multiplication result $L_4$ and data y(t–1) are supplied to full adder 57, so that the addition result $L_5$ shown in equation 5 is calculated. This addition result $L_5$ is outputted through the medium of delay element $D_2$, so that it is supplied to selector 53 in sampling clock 2-0. Furthermore, addition result $L_5$ is supplied through the medium of delay element $D_4$ so that it is supplied to the data input terminal of filtering register 55 in sampling clock 2-1. At this time, addition result $L_5$ is written into filtering register 55 as the data y(t) of delay $R_1$ at the present time T.

Here, the data which were written as y(t) are read out in sampling clocks 0-3 and 1-5 as data y(t–1), which were delayed by 1 sampling period. Filtering register 55 operates as a shift register, so that the writing address and the readout address are identical. That is to say, in sampling clocks 0-3, 1-5 and 2-1, the address FLT-ad supplied by filtering parameters supplier $\mathbf{20}_1$ has the same contents. As explained above, this is caused by the fact that the order of writing and readout is reversed.

[6] Calculation of Multiplication Result $L_6$

Next, in sampling clock 2-0, selector 3 selects input terminal B. At this time, the addition result $L_5$ is supplied to input terminal B of the same selector, so that the addition result is supplied to multiplier 58.

In sampling clock 1-7, selector 54 selects input terminal B. By means of this, the parameter FLT-fc which was supplied from filtering parameters supplier $20_1$ to the input terminal, is supplied to multiplier 58 through the medium of delay element $D_6$ in sampling clock 2-0. This parameter FLT-fc corresponds to the coefficient $K_2$ shown in FIG. 4. Accordingly, in sampling clock 2-0, addition result $L_5$ and coefficient $K_2$ are supplied to multiplier 58, so that the multiplication result $L_6$ shown in Equation 6 is calculated. This multiplication result $L_6$ is supplied through the medium of delay element 3D, so that it is supplied to selector 51 in sampling clock 2-3.

[7] Calculation of Addition Result $L_7$

Next, in sampling clock 2-3, selector 51 selects input terminal B and selector 52 selects input terminal A. At this time, the multiplication result $L_6$ is supplied to selector 51, so that this multiplication result is supplied to input terminal B of full adder 57 through the media of exclusive-OR gate 59 and delay element $D_6$. That is to say, multiplication result $L_6$ is supplied to input terminal B of full adder 57 in sampling clock 2-4.

In sampling clock 2-2, data X(t−1) of register $R_2$ are read out again from filtering register 55. These data are supplied through the medium of delay element $D_8$, so that they are supplied to input terminal A of selector 52 in sampling clock 2-3. At this time, selector 52 selects the input terminal stated above. As a result, data X(t−1) are supplied through the medium of delay element $D_1$, so that they are supplied to input terminal A of full adder 57 in sampling clock 2-4.

Accordingly, in sampling clock 2-4, multiplication result $L_6$ and data X(t−1) are supplied to full adder 57, so that the addition result $L_7$ shown in equation 7 is calculated. This addition result $L_7$ is supplied through the medium of delay element $D_2$, so that this is outputted from output terminal FILT-OUT in sampling clock 2-5 through the medium of delay element $D_4$. As a result, in sampling clock 2-6, this is supplied to the data input terminal of filtering register 55.

At this time, addition result $L_7$ is written into filtering register 55 as data X(t) of a new delay $R_2$. Here, the data written as X(t) are read out in sampling clock 1-0 and sampling clock 2-2 with a 1 sampling period delay as data x(t−1). However, in this case as well, the writing address and the readout address are identical for the same reasons as in the case of y(t) described above; that is to say, because the order of writing and readout is reversed. That is to say, in sampling clocks 1-0, 2-2, and 2-6, the address FLT-ad supplied from filtering parameters supplier $20_1$ has identical contents.

In this way, by means of the control program shown in FIG. 9, filtering is conducted with respect to the musical tone signal in channel 0 ch in the period from sampling clock 0-0 to sampling clock 2-7.

Next, the filtering with respect to the musical tone signal of tone generation channel 1 ch is conducted in such a manner as to be delayed by 1 block with respect to the processing of the tone generation channel 0 ch described above and as shown in FIG. 9. Hereinafter, in the same manner, the filtering with respect to the musical tone signal of a channel n ch is conducted in such a manner as to be delayed by 1 block with respect to channel (n−1) ch. As a result, for example, in the period of the block number 2 shown in FIG. 9, the filtering of the musical signals of channels 0– 2 ch proceeds simultaneously and without hindrance.

The filtering algorithm of the 32 channels is identical for each tone generation channel. However, differing filtering parameters are supplied from filtering parameters supplier $20_1$ for each tone generation channel, so that individual filtering can be executed with respect to the musical tone signals of the 32 channels.

(9) Operation of the Reverberation Effecting Circuit

The reverberating effecting circuit is realized by means of the time shared operation of the operating units A shown in FIG. 7 or the operating units B shown in FIG. 8. First, the operation of operating unit A will be explained with reference to FIG. 10. Here, in order to simplify the explanation, operating unit A is explained with reference to the case in which operating units 73 and 74 are operated.

FIG. 10 shows the timetable of a control program for executing reverberation effecting. To explain in greater detail, the selection of selectors 51–54 and the control of reverberating register 56 in computing part 5 is displayed in terms of a timetable.

The operating units which execute the reverberation effecting circuit are comprising, as in the case of the filtering described above, 3 blocks "0"–"2". Each block comprises 8 steps (sampling clocks). Computing part 5 executes the operations [1]–[7] described hereinbelow, and obtains the various operational results $L_{11}$–$L_{17}$ of operating unit A (see FIG. 7).

[1] Calculation of Multiplication Result $L_{11}$

First, as shown in FIG. 10, in sampling clock 0-2, selector 53 selects input terminal D. At this time, input data $E_1$, which were read out of reverberating register 56 in sampling clock 0-1, are supplied to input terminal D of selector 53 through the medium of delay element $D_9$. As a result, these input data are supplied to multiplier 58.

In sampling clock 0-1, selector 54 selects input terminal C. At this time, the parameter REV-COEF from reverberating parameters suppliers $20_2$ is supplied to input terminal C as coefficient $K_4$ of operating unit A, and is supplied in sampling clock 0-2 to multiplier 58 through the medium of delay element $D_6$ (see FIG. 3).

Accordingly, in sampling clock 0-2, coefficient $K_4$ and input data $E_1$ are supplied to multiplier 58, and a multiplication result $L_{11}$, wherein $L_{11}=K_4 \cdot E_1$, is calculated. This multiplication result $L_{11}$ is supplied through the medium of delaying element 3D, so that it is supplied to selector 51 in sampling clock 0-5. At this time, selector 51 selects input terminal B, and furthermore, multiplication result $L_{11}$ is supplied through the medium of delay element $D_6$, so that this multiplication result is supplied to input terminal B of full adder 57 in sampling clock 0-6.

In sampling clock 0-5, selector 52 does not select an input terminal, so that nothing is inputted into input terminal A of full adder 57 in sampling clock 0-6. Accordingly, in sampling clock 0-6, full adder 57 adds nothing to multiplication result $L_{11}$, and output it. That is to say, multiplication result $L_{11}$ is outputted in an unchanged manner. In this case, in sampling clock 0-5 it is also acceptable for selector 52 to select "0".

[2] Calculation of Multiplication Result $L_{12}$

In sampling clock 0-5, selector 53 selects input terminal D. In sampling clock 0-4, input data $E_2$ are read out of reverberating register 56. By means of this, these input data are supplied to multiplier 58 in sampling clock 0-5. Furthermore, in sampling clock 0-4, selector 54 selects input terminal C. At this time, the parameter REV-COEF which is supplied to input terminal C is coefficient $K_5$ of operating unit A shown in FIG. 7 (1). By means of this, coefficient $K_5$ is supplied to multiplier 58 in sampling clock 0-5.

Accordingly, in sampling clock 0-5, coefficient $K_5$ and input data $E_2$ are supplied to multiplier 58, and a multiplication result $L_{12}$, wherein $L_{12}=K_5 \cdot E_2$, is calculated. This multiplication result $L_{12}$ is supplied through the medium of delay element 3D, so that this multiplication result is supplied to input terminal B of selector 51 in sampling clock 1-0.

[3] Calculation of Addition Result $L_{13}$

In sampling clock 1-0, selector 51 selects input terminal B. At this time, multiplication result $L_{12}$ is supplied to input terminal B of this selector, and delay element $D_6$ is connected to the output of this selector. As a result, in sampling clock 1-1, multiplication result $L_{12}$ is supplied to input terminal B of full adder 57. In sampling clock 1-0, selector 52 selects input terminal D. At this time, multiplication result $L_{11}$ is supplied to the input terminal D of selector 52. This is because the multiplication result $L_{11}$ outputted from full adder 57 and sampling clock 0-6 is delayed by 2 sampling clocks through the medium of delay elements $D_2$ and $D_3$. By means of this, multiplication result $L_{11}$ is supplied from selector 52 though the medium of delay element $D_1$, and is supplied to input terminal A of full adder 57 in sampling clock 1-1. Accordingly, in sampling clock 1-1, multiplication results $L_{11}$ and $L_{12}$ are supplied to full adder 57, and addition result $L_{13}$, wherein $L_{13}=L_{11}+L_{12}$, is calculated.

[4] Calculation of Multiplication Result $L_{14}$

In the same manner as in the case of the calculation of the multiplication results $L_{11}$ and $L_{12}$ described above, in sampling clock 0-7, selector 53 selects input terminal D, and input data $E_3$ are read out from reverberating register 56 in sampling clock 0-6. By means of this, input data $E_3$ are supplied to multiplier 58 in sampling clock 0-7. Furthermore, in sampling clock 0-6, selector 54 selects input terminal C. At this time, the parameter REV-COEF supplied to input terminal C is coefficient $K_6$ of operating unit A (see FIG. 7). By means of this, coefficient $K_6$ is supplied to multiplier 58 in sampling clock 0-7.

Accordingly, in sampling clock 0-7, coefficient $K_6$ and the data of register $E_3$ are supplied to multiplier 58, and a multiplication result $L_{14}$, wherein $L_{14}=K_6 \cdot E_3$, is calculated. This multiplication result $L_{14}$ is supplied through the medium of delay element 3D, so that it is delayed by 3 sampling clocks, and is supplied to input terminal B of selector 51 in sampling clock 1-2.

[5] Calculation of Addition Result $L_{15}$

In sampling clock 1-2, selector 51 selects input terminal B. At this time, multiplication result $L_{14}$ is supplied to input terminal B of this selector 51. Furthermore, delay element $D_6$ is connected to the output of this selector 51, so that multiplication result $L_{14}$ is supplied to the input terminal B of full adder 57 in sampling clock 1-3.

In sampling clock 1-2, selector 52 selects input terminal C. At this time, addition result $L_{13}$ is supplied to input terminal C of the same selector 52. This is because the addition result $L_{13}$ which was outputted by full adder 57 in sampling clock 1-1 is delayed by 1 sampling clock through the medium of delay element $D_2$. By means of this, addition result $L_{13}$ is supplied from selector 52 through the medium of delay element $D_1$, and is supplied to the input terminal A of full adder 57 in sampling clock 1-3. Accordingly, in sampling clock 1-3, addition result $L_{13}$ and multiplication result $L_{14}$ are supplied to full adder 57, and an additional result $L_{15}$, wherein $L_{15}=L_{13}+L_{14}$, is calculated.

[6] Calculation of Multiplication Result $L_{16}$

In the same manner as in the case of the multiplication results $L_{11}$, $L_{12}$, and $L_{14}$, in sampling clock 1-1, selector 53 selects input terminal D, and in sampling clock 1-0, input data $E_4$ are read out from reverberating register 56. By means of this, in sampling clock 1-1, input data $E_4$ are supplied to multiplier 58.

Furthermore, in sampling clock 1-0, selector 54 selects input terminal C. At this time, the parameter REV-COEF which is supplied to input terminal C is coefficient $K_7$ of operating unit A (see FIG. 7). As a result, in sampling clock 1-1, coefficient $K_7$ is supplied to multiplier 58.

Accordingly, in sampling clock 1-1, coefficient $K_7$ and input data E4 are supplied to multiplier 58, and a multiplication result L16, wherein $L_{16}=K_7 \cdot E_4$, is calculated. This multiplication result $L_{16}$ is supplied through the medium of delay element 3D, so that it is supplied to the input terminal B of selector 51 with a 3-sampling clock delay, in sampling clock 1-4.

[7] Calculation of Addition Result $L_{17}$

In sampling clock 1-4, selector 51 selects input terminal B. At this time, multiplication result $L_{16}$ is supplied to input terminal B of selector 51. Furthermore, delay element $D_6$ is connected to the output of selector 51, so that the multiplication result is supplied to input terminal B of full adder 57 in sampling clock 1-5.

In sampling clock 1-4, selector 52 selects input terminal C. At this time, addition result $L_{15}$ is supplied to input terminal C of selector 52. This is because addition result $L_{15}$, which was outputted from full adder 57 in sampling clock 1-3, is delayed by 1 sampling clock through the medium of delay element $D_2$. By means of this, the addition result is supplied from selector 52 through the medium of delay element $D_1$, and is supplied to input terminal A of full adder 57 in sampling clock 1-5.

Accordingly, in sampling clock 1-5, addition result $L_{15}$ and multiplication result $L_{16}$ are supplied to full adder 57, and an addition result $L_{17}$, wherein $L_{17}=L_{15}+L_{16}$, is calculated. This addition result $L_{17}$ is delayed by 2 sampling clocks through the medium of delay elements $D_2$ and $D_5$, and is written into reverberating register 56 as output data $F_1$.

The operating unit A, which obtains each of these operation results $L_{11}$–$L_{17}$ in this manner, corresponds to the operating units 70–74 which are shown in FIG. 6, and as shown in FIG. 9, these are operated in 3-block periods.

For example, when the processing of an operating unit 73 using an operating unit A is conducted, at the readout timings of the input data $E_1$–$E_4$ in operating unit A, the respectively corresponding delay data $DC_2$, $DC_4$, $DC_6$, and $DC_8$ are read out from reverberating register 56. This is conducted by means of designating addresses $A_2$, $A_4$, $A_6$, and $A_8$ as address REV-ad. Furthermore, the coefficients $K_4$–$K_7$ of parameter REV-COEF are supplied as coefficients $C_5$, $C_7$, $C_9$, and $C_{11}$ in operating unit 73, at each supply timing. Furthermore, the output data $F_1$ of operating unit A are temporarily stored in reverberating register 56 as addition result $TC_1$ of operating unit 73.

In the same manner, when the processing of operating unit 74 which uses operating unit A is conducted, at the readout timings of input data $E_1$–$E_4$ in operating unit A, the respectively corresponding delay data $DC_3$, $DC_5$, $DC_7$, and $DC_9$ are read out from reverberating register 56. This is conducted by means of designating the addresses $A_3$, $A_5$, $A_7$, and $A_9$ as address REV-ad. Furthermore, the coefficients $K_4$–$K_7$, which are parameter REV-COEF, are supplied at each supply timing as coefficients $C_6$, $C_8$, $C_{10}$, and $C_{12}$ in operating unit 74. Then, the output data $F_1$ of operating unit A are temporarily stored in reverberating register 56 as addition result $TC_2$ of operating unit 74.

Next, the operations at the time of the conducting of the processing of operating units 70–72 (see FIG. 6) by means of operating unit A will be explained. In this case, the differences with the above-described operating units 73 and 74 lie in the fact that input data $E_1$ in operating unit A comprise a left signal in operating unit 70 and 72, and comprise a right signal in operating unit 71.

In the timetable shown in FIG. 10, in sampling clock 0-2, selector 53 selects input terminal D. However, in accordance with the points of difference mentioned above, when the processing of operating units 70–72 is conducted, the selector 53 selects input terminal A. At this time, panning circuit 13 (see FIG. 1) generates a left signal when operating unit 70 or 72 is executed, and generates a right signal when operating unit 71 is executed, and supplies these through the medium of input terminal REV-IN.

When the processing of operating unit 72 is conducted, the input data $E_2$ in operating unit A comprise a right signal, and in sampling clock 0-5, selector 53 selects input terminal A. In operating units 70-72, the input data $E_4$ and the multiplication coefficient which is multiplied by the input data $E_4$ in operating unit A have values of "X" and "0", respectively.

In the case in which a representation is to be made of the processing of operating units 70–74 by means of operating unit A, in sampling clock 1-1, a selection signal is not supplied to selector 53. In this case, the selection of an input terminal in selector 53 is indeterminate. However, in the present preferred embodiment, in sampling clock 1-0, the value of the coefficient $K_7$ which is supplied as parameter REV-COEF to input terminal C of selector 54 is set to a value of "0" in accordance with the multiplication coefficient in operating unit 70. As a result, because coefficient $K_7$ is supplied through the medium of delay element $D_6$, this coefficient is supplied to multiplier 58 in sampling clock 1-1. By means of this, the multiplication result of the multiplier 58 becomes "0", and this is the multiplication result $L_{15}$ in operating unit A.

In the same manner, the input data $E_3$ of the operating unit A corresponding to operating unit 72 and the multiplication coefficient multiplied by this input data $E_3$ have values of "X" and "0", respectively. In this case, in sampling clock 0-7, a selection signal is not supplied to selector 53, and in sampling clock 0-6, the coefficient $K_6$ which is supplied as parameter REV-COEF to input terminal C of selector 54 has a value of "0", in accordance with the multiplication coefficient in operating unit 70. As a result, this coefficient is supplied through the medium of delay element $D_6$, so that the coefficient is supplied to multiplier 58 in sampling clock 0-7, and the multiplication result of multiplier 58 becomes "0". This is the multiplication result $L_{14}$ in operating unit A.

In this manner, in the present preferred embodiment, the coefficients $K_6$ and $K_7$ which are supplied as parameter REV-COEF, are given values of "0" at supply timings thereof, and thereby, the processing of the input data "X" and the multiplication coefficient "0" in operating units 70–72 is accomplished.

Furthermore, the multiplication coefficients $C_{23}$ and $C_{24}$ in operating units 70 and 71 are supplied to the multipliers $TC_{23}$ and $TC_{24}$, which determine the size of the left and right outputs, as can be seen from the reverberation effecting circuit shown in FIG. 5. That is to say, in the processing of operating units 70 and 71 by means of operating unit A, multiplication coefficients $C_{23}$ and $C_{24}$ are supplied not as parameter REV-COEF, but rather as coefficient $K_6$ of parameter REV-VOL.

Accordingly, in representing the processing of operating unit 70 by means of operating unit A, the situation is different from that shown in FIG. 11 in that selector 54 selects input terminal D in sampling clock 0-6, and in sampling clock 0-5, multiplication coefficient $C_{23}$ is supplied to input terminal D of selector 54 as coefficient $K_6$ of parameter REV-VOL.

In the same way, when the processing of operating unit 71 is conducted by means of operating unit A, selector 54 selects input terminal D in sampling clock 0-6, and multiplication coefficient $C_{24}$ is supplied to input terminal D of selector 54 as coefficient $K_6$ of parameter REV-VOL in sampling clock 0-5.

In this manner, when processing is conducted using operating unit A, as a result of the differences of operating units 70–74, the selection of the selectors 51–54 and the writing/readout control of reverberating register 56 are conducted fundamentally in accordance with the timetable shown in FIG. 11, and the operations of operating unit A are conducted repeatedly in correspondence with the individual operating units 70–74.

Furthermore, computing part 5 determines operation results $L_{18}$–$L_{23}$ of operating unit B (see FIG. 8) in accordance with the timetable shown in FIG. 12. The points of difference between this timetable and the timetables shown in FIG. 10 are given hereinbelow.

a) In sampling clock 1-3, addition result $L_{20}$ is written into reverberating register 56 as output data $F_2$.

b) In sampling clock 1-2, multiplication result $L_{21}$ has nothing added thereto, so that selector 52 selects nothing.

Other than this, computing part 5 proceeds in accordance with the timetable in FIG. 12, in a manner identical to that of operating unit A, and the operations of operating unit B are repeatedly conducted in correspondence with the individual operating units 75 and 76.

As shown in FIG. 9, computing part 5 executes the operations of operating units 70–76 in order in correspondence with operating units A and B. That is to say, computing part 5 executes operating unit 70 in the period of blocks 0-2, executes operating unit 71 with a 1-block (8 clock) delay, and in the same manner, executes all operating units up through operating unit 76. Accordingly, computing part 5 executes operating units 70–76 in 1 sampling period T, so that reverberating effecting is conducted with respect to the left and right signals of panning circuit 13 (see FIG. 1).

As explained above, computing part 5 conducts filtering, and, by means of operating units 70–76, reverberation effecting with respect to musical tone signals in channels 0–31 ch in a time-shared manner and in 1 sampling period T. At this time, as is clear from FIGS. 10–12, there is no overlap among the selection control of selectors 51–54, the read out/writing control of filtering register 55, and the read out/writing control of reverberating register 56, in computing part 5.

For example, in the second block of the sampling period shown in FIG. 9, the filtering of the musical tone signals of channels 0–2 ch and the processing of operating units 70–72 proceed simultaneously. However, the operating timing of full adder 57 and multiplier 58 does not overlap at the sampling clock level. This is achieved by providing delay elements between each selector 51–54, full adder 57, and multiplier 58 in computing part 5.

Furthermore, the filtering is divided into channels, and the reverberation effecting is divided into operating units, as a unit of the operational algorithm, and these operational algorithms are executed in such a manner that they are delayed by a fixed period. As a result, it is possible to process a plurality of inputted data in a time-shared manner so that there is no mutual hindrance, and to output these data. Furthermore, filtering and reverberation effecting are conducted in the same computing part 5, so that the circuit composition is simplified.

(Second Preferred Embodiment)

In the above-described preferred embodiment, after filtering was applied to the musical tone signals, reverberation was applied. However, in the composition of the present preferred embodiment, if the content of the control program is rewritten, it is possible to apply effects such as chorus, flanger, distortion, exciter, or the like. Furthermore, these effects may be applied not merely to the same musical tone signal, but a plurality of different effects may be applied to a plurality of differing musical tone signals. In addition, it is possible to apply differing effects in a parallel manner to a single musical tone signal.

What is claimed is:

1. A digital signal processing apparatus for conducting filtering and applying reverberation with respect to a generated musical tone signal, comprising:

designating means for generating filtering designation data designating characteristics of said filtering, reverberating designation data designating characteristics of said reverberation, and combination data designating combined characteristics of said filtering and said reverberation, parameter generating means for generating filtering parameters in accordance with said filtering designation data, and for generating reverberating parameters in accordance with said reverberating designation data and said combination data, memory means for storing a plurality of operating algorithms, readout means for reading first and second operating algorithms from said memory means, computing means for filtering said musical tone signal in accordance with said filtering parameters based on said first operating algorithm, and for imparting reverberation characteristics to said musical tone signal in accordance with said reverberating parameters based on said second operating algorithm, said computing means processing said first and said second operating algorithms simultaneously during a single sampling period.

2. A digital signal processing apparatus in accordance with claim 1, wherein said filtering parameters include at least a cut-off frequency and a resonance value expressing said filtering characteristics, and information providing necessary delay amounts is provided at a time of said filtering.

3. A digital signal processing apparatus in accordance with claim 1, wherein said reverberating parameters include at least a reverberation output level and a reverberation coefficient expressing said reverberation characteristics, and information providing necessary delay amounts for said reverberation is provided.

4. A digital signal processing apparatus in accordance with claim 1, wherein said parameters generating means generates said filtering parameters and reverberating parameters in accordance with tone color information set in a predetermined manner, and said filtering parameter and said reverberating parameters are synchronized with a key-on signal designating musical tone generation, and outputted.

5. An electronic musical instrument for applying a mutually differing first effect and second effect with respect to musical tones generated in accordance with a performance operation, comprising:

(a) a plurality of selecting means, including first through fourth selecting means, for selecting signals supplied to a plurality of provided input terminals, and for predetermined time delaying said signals and outputting said signals, (b) multiplying means for multiplying an output of said second selecting means and an output of said first selecting means, delaying output of a multiplication result thereof by a predetermined time, and outputting said multiplication result, (c) adding-subtracting means, for conducting one of addition and subtraction of an output of said third selecting means and an output of said fourth selecting means, delaying output of an addition result or a substraction result thereof by a predetermined time and outputting said result, (d) first delay means, for applying a desired delay to said first effect with respect to an output of said adding-subtracting means, and outputting said first effect as a first delay signal, (e) second delay means, for applying a desired delay amount to said second effect with respect to an output of said adding-subtracting means, and outputting said second effect as a second delay signal, and (f) selectively controlling said first through fourth selecting means in a time-shared manner based on a first operating algorithm corresponding to said first effect and a second operating algorithm corresponding to said second effect, and for directing addition operation or subtraction operation of said adding subtracting means, wherein said musical tone signal and an output of said adding-subtracting means, said first delay signal, and said second delay signal are supplied to said first selecting means, a first parameter, expressing contents of said first effect, and a second parameter, expressing contents of said second effect, are supplied to said second selecting means, an output of said multiplier and an output of said adding-subtracting means are supplied to said third selecting means, said musical tone signal, said first delay signal, and an output of said adding-subtracting means are supplied to said fourth selecting means, and said time-shared control means performing a digital filter operation having characteristics corresponding to said first parameter in accordance with said first operating algorithm, and said time-shared control means performing a reverberation operation corresponding to said second parameter in accordance with said second operating algorithm, said digital filtering operation and said reverberation operation being performed in a time shared manner, and said time-shared control means processing said first effect and said second effect in parallel.

6. An electronic musical instrument in accordance with claim 5, wherein said first delaying means and said second delaying means are comprising shift registers.

7. An electronic musical instrument in accordance with claim 5, wherein said time shared control means processes said first effect and said second effect in parallel within one sampling period.

8. An electronic musical instrument in accordance with claim 5, wherein said operating unit simulates an initial reflecting tone and a final reverberating tone.

9. A digital signal processing apparatus comprising:

first memory means for storing a plurality of control programs, readout means for reading at least two control programs out of said first memory means during a single sampling period, operating means, including a plurality of adders and multipliers for performing a plurality of addition, subtraction, and multiplication operations, operating means for processing said at least two control programs, a plurality of selectors for selecting input data to be supplied to said plurality of adders and multipliers, based on said at least two control programs read out by said readout means, second memory means for storing result data output by said plurality of adders and multipliers, based on said at least two control programs read out by said readout means, and delaying means for delaying data supplied to a connection line within which said delaying means is provided by a predetermined delay amount, said connection line being connected to said second memory means, said operator, and said selectors, wherein said operating means processes said at least two control programs simultaneously during a single sampling period.

10. A digital signal processing apparatus for applying digital effects to a generated musical tone signal, comprising:

designating means for generating effects designation data, which designate characteristics of said digital effects, parameters generating means for generating effects parameters which express effects characteristics in accordance with said effects designation data, memory means for storing a plurality of operating algorithms, each of which designates said effects designation data, and computing means for applying said digital effects to said generated musical tone signals, said computing means applying said digital effects in accordance with said effects parameters based on said plurality of operating algorithms, wherein, said operating algorithms are processed simultaneously by said computing means during a single sampling period.

11. A digital signal processing apparatus comprising:

designating means for generating effects designation data, parameters generating means for generating a plurality of effects parameters which express effects characteristics in accordance with said effects designation data, memory means for storing a plurality of operating algorithms for designating said effects designation data, readout means for reading said plurality of operating algorithms from said memory means, tone generation means for generating a digital musical tone signal, computing means for imparting a first digital effect and a second digital effect to said musical tone signal, each of said first and said second digital effects being imparted in accordance with at least one of said plurality of effects parameters and based upon one of said operating algorithms, and processing control means for controlling processing of said musical tone signal by said computing means, wherein after said first digital effect has been imparted to said musical tone signal, said processing control means feeds said musical tone signal back to said computing means to impart said second digital effect to the musical tone signal.

12. The digital signal processing apparatus of claim 11, wherein said processing control means further comprises:

an envelope generator for generating an envelope waveform corresponding to said musical tone signal, an accumulator for accumulating a plurality of musical tone signals supplied by said envelope generator, and a panning circuit for splitting each of said musical tone signals into a stereo left signal and a stereo right signal.

13. A digital signal processing apparatus for performing a filtering operation and a reverberation operation on a generated musical tone signal, comprising:

designating means for generating filtering designation data for controlling characteristics of said filtering operation, reverberation designation data for controlling characteristics of said reverberation operation, and characteristics data indicative of combined characteristics of said filtering and said reverberation operations, parameter generating means for generating filtering parameters in accordance with said filtering designation data, and for generating reverberating parameters in accordance with said reverberating designation data and said characteristics data, memory means for storing a plurality of operating algorithms;

readout means for reading a first operating algorithm and a second operating algorithm out of said memory means, and computing means for filtering said musical tone signal in accordance with said filtering parameters based on said first operating algorithm, and for imparting reverberation characteristics to said musical tone signal in accordance with said reverberating parameters based on said second operating algorithm, said computing means processing said first and said second operating algorithms within a same sampling period, wherein, each of said first and second algorithms comprise a plurality of computing units, said computing means delaying processing of a second computing unit by a predetermined period of time after processing a first computing unit.

* * * * *